US010036510B2

(12) United States Patent
Heinen et al.

(10) Patent No.: US 10,036,510 B2
(45) Date of Patent: Jul. 31, 2018

(54) APPARATUS AND METHOD FOR PERIODICALLY CHARGING OCEAN VESSEL OR OTHER SYSTEM USING THERMAL ENERGY CONVERSION

(71) Applicant: Raytheon Company, Waltham, MA (US)

(72) Inventors: Gregory W. Heinen, Lowell, MA (US); Pierre J. Corriveau, Portsmouth, RI (US)

(73) Assignee: Raytheon Company, Waltham, MA (US)

( * ) Notice: Subject to any disclaimer, the term of this patent is extended or adjusted under 35 U.S.C. 154(b) by 101 days.

(21) Appl. No.: 15/173,178

(22) Filed: Jun. 3, 2016

(65) Prior Publication Data

US 2017/0350558 A1 Dec. 7, 2017

(51) Int. Cl.

| | |
|---|---|
| ***F17C 9/04*** | (2006.01) |
| ***B63G 8/00*** | (2006.01) |
| ***B63G 8/14*** | (2006.01) |

(52) U.S. Cl.

CPC ..... *F17C 9/04* (2013.01); *B63G 8/00* (2013.01); *B63G 8/14* (2013.01)

(58) Field of Classification Search

CPC ..... F17C 9/04; B63G 8/00; B63G 8/14
USPC ..... 114/312
See application file for complete search history.

(56) References Cited

U.S. PATENT DOCUMENTS

| | | | | |
|---|---|---|---|---|
| 952,452 A | | 5/1910 | Leon | |
| 1,315,267 A | | 9/1919 | White | |
| 1,361,561 A | | 12/1920 | Yancey | |
| 1,421,369 A | | 7/1922 | Ardo | |
| 1,710,670 A | | 4/1929 | Bonney | |
| 2,000,746 A | * | 5/1935 | Dray | B63G 8/24 114/336 |
| 2,381,478 A | | 9/1942 | Zukor | |

(Continued)

FOREIGN PATENT DOCUMENTS

| | | | |
|---|---|---|---|
| DE | 215277 | C | 12/1906 |
| EP | 2660433 | A1 | 11/2013 |
| EP | 2698506 | A1 | 2/2014 |
| GB | 235363 | A | 6/1925 |
| GB | 541775 | A | 12/1941 |
| GB | 658070 | A | 10/1951 |
| GB | 2422877 | A | 8/2006 |
| WO | 2011000062 | A1 | 1/2011 |

OTHER PUBLICATIONS

U.S. Appl. No. 11/081,092, filed Aug. 25, 1914, Gustav M. LaGergren.

(Continued)

*Primary Examiner* — S. Joseph Morano
*Assistant Examiner* — Jovon Hayes

(57) ABSTRACT

An apparatus includes multiple tanks each configured to receive and store a liquid refrigerant under pressure. The apparatus also includes one or more insulated water jackets each configured to receive and retain water around at least part of an associated one of the tanks. The apparatus further includes at least one generator configured to receive a flow of the liquid refrigerant and to generate electrical power based on the flow of the liquid refrigerant. The apparatus also includes one or more first valves configured to control the flow of the liquid refrigerant between the tanks and through the at least one generator. In addition, the apparatus includes one or more second valves configured to control a flow of the water into and out of the one or more insulated water jackets.

21 Claims, 16 Drawing Sheets

(56) References Cited

U.S. PATENT DOCUMENTS

| | | | | | |
|---|---|---|---|---|---|
| 2,537,929 | A | | 1/1951 | Daly et al. | |
| 2,642,693 | A | | 6/1953 | Broady | |
| 2,720,367 | A | | 10/1955 | Doolittle | |
| 2,750,794 | A | * | 6/1956 | Downs | G01N 33/18 307/650 |
| 2,783,955 | A | | 3/1957 | Fitz | |
| 2,823,636 | A | * | 2/1958 | Gongwer | B63G 8/18 114/144 R |
| 2,826,001 | A | * | 3/1958 | Presnell | A63H 23/04 114/331 |
| 2,845,221 | A | | 7/1958 | Vine et al. | |
| 2,964,874 | A | * | 12/1960 | Armando | A63H 23/02 137/223 |
| 3,157,145 | A | * | 11/1964 | Farris | B63G 8/08 114/332 |
| 3,698,345 | A | | 10/1972 | Kreitner | |
| 3,818,523 | A | * | 6/1974 | Stillman, Jr. | B63B 22/18 114/333 |
| 4,445,818 | A | * | 5/1984 | Ohsaki | F15B 11/17 417/288 |
| 4,577,583 | A | | 3/1986 | Green, II | |
| 4,850,551 | A | * | 7/1989 | Krawetz | B64B 1/24 244/25 |
| 4,919,637 | A | * | 4/1990 | Fleischmann | A63H 23/04 114/333 |
| 5,134,955 | A | | 8/1992 | Manfield | |
| 5,291,847 | A | * | 3/1994 | Webb | B63G 8/08 114/331 |
| 5,303,552 | A | * | 4/1994 | Webb | B63B 22/22 114/331 |
| 5,615,632 | A | * | 4/1997 | Nedderman, Jr. | F42B 10/14 114/330 |
| 6,142,092 | A | * | 11/2000 | Coupland | B63B 22/18 114/331 |
| 6,263,819 | B1 | | 7/2001 | Gorustein et al. | |
| 6,328,622 | B1 | | 12/2001 | Geery | |
| 8,069,808 | B1 | * | 12/2011 | Imlach | B63G 8/24 114/331 |
| 8,205,570 | B1 | * | 6/2012 | Tureaud | B63G 8/14 114/330 |
| 9,834,288 | B1 | * | 12/2017 | Heinen | B63G 8/001 |
| 2007/0186553 | A1 | * | 8/2007 | Lin | F01K 15/02 60/650 |
| 2008/0022681 | A1 | * | 1/2008 | Tafas | F01K 23/065 60/618 |
| 2008/0088171 | A1 | * | 4/2008 | Cheng | E21B 41/0064 299/10 |
| 2009/0178603 | A1 | * | 7/2009 | Imlach | B63G 8/22 114/331 |
| 2009/0320477 | A1 | * | 12/2009 | Juchymenko | F01K 23/065 60/651 |
| 2010/0327605 | A1 | * | 12/2010 | Andrews | F01K 25/10 290/1 R |
| 2011/0101579 | A1 | | 5/2011 | Polakowski et al. | |
| 2012/0091942 | A1 | * | 4/2012 | Jones | F03G 7/05 320/101 |
| 2012/0289103 | A1 | * | 11/2012 | Hudson | F42B 19/00 440/38 |
| 2017/0349252 | A1 | * | 12/2017 | Heinen | B63G 8/14 |
| 2017/0350558 | A1 | * | 12/2017 | Heinen | F17C 9/04 |

OTHER PUBLICATIONS

Foreign Communication from Related Counterpart Application, PCT Application No. PCT/US2016/062518, International Search Report and the Written Opinion of the International Searching Authority dated May 18, 2017, 12 pages.

Gregory W. Heinen, "Hydraulic Drives for Use in Charging Systems, Ballast Systems, or Other Systems of Underwater Vehicles," U.S. Appl. No. 15/173,214, filed Jun. 3, 2016.

Gregory W. Heinen, et al., "Systems and Methods Supporting Periodic Exchange of Power Supplies in Uderwater Vehicles or Other Devices," U.S. Appl. No. 15/264,399, filed Sep. 13, 2016.

Bowen, M.F., "A Passive Capture Latch for ODYSSEY-Class AUVs," Technical Report WHOI-98-12, Jun. 12, 1998, 91 pages, publisher Woods Hole Oceanographic Institution, Woods Hole, MA.

Singh, Hanumant, et al., "Docketing for an Autonomous Ocean Sampling Network," IEEE Journal of Oceanic Engineering, Oct. 2001, pp. 498-514, vol. 26, No. 4, publisher IEEE, Piscataway, New Jersey.

Bowen, Andrew D., et al., "The Nereus Hybrid Underwater Robotic Vehicle for Global Ocean Science Operations to 11,000m Depth," 2008, 10 pages, publisher IEEE, Piscataway, New Jersey.

Hardy, Tim, et al., "Unmanned Underwater Vehicle (UUV) deployment and retrieval considerations for submarines," Paper on UUV Development and Retrieval Options for Submarines, Apr. 2008, pp. 1-15, publisher BMT Defense Services Ltd., Bath, United Kingdom.

Cowen, Steve, "Flying Plug: A Small UUV Designed for Submarine Data Connectivity (U)," Abstract, 1997, 21 pages, publisher PN.

Gish, Lynn Andrew, "Design of an AUV Recharging System," 2004, 134 pages, publisher Massachusetts Institute of Technology, Cambridge, Massachusetts.

Vandenberg, Troy D., "Manning and Maintainability of a Submarine Unmanned Undersea Vehicle (UUV) Program: A Systems Engineering Case Study," Thesis, Sep. 2010, 137 pages, publisher Naval Postgraduate School, Monterey, California.

Griffiths, Gwyn, "Technology and Applications of Autonomous Underwater Vehicles," 2003, pp. 93-108, publisher Taylor & Franscis, New York, NY.

Galletti Di Cadilhac, Robin, "Docketing System," 2003, pp. 93-108, publisher Taylor & Franscis, New York, NY.

Singh, Hanumant, et al., "AOSN MURI: Docketing for an Autonomous Ocean Sampling Network," Program #: ONR-322 OM/AOSN N00014-95-1-13166, 1998, 6 pages, available at http://www.whoi.edu/DSL/hanu/.

Jack A. Jones et al., "Novel Thermal Powered Technology for UUV Persistant Surveillance", California Institute of Technology, Feb. 10, 2006, 11 pages.

Terry Huntsberger et al., "Slocum-TREC Thermal Glider", California Institute of Technology, Jan. 31, 2012, 16 pages.

Terry Huntsberger et al., "Advanced Energy Storage System for Thermal Engines", California Institute of Technology, Jan. 31, 2013, 16 pages.

Yi Chao, "Diurnal Variability Part I: Global 1-km SST (G1SST) Part II:GHRSST-DV-Argo Obs. System", California Institute of Technology, Feb. 28, 2011, 19 pages.

NASA,"Utilizing Ocean Thermal Energy in a Submarine Robot", NASA's Jet Propulsion Laboratory, NASA Tech Briefs NPO-43304, Dec. 18, 2008, 4 pages.

T. Shimura et al., "Long-Range Time Reversal Communication in Deep Water: Experimental Results", J. Acoust. Soc. Am. 132 (1), Jul. 2012, [http://dx.doi.org/10.1121/1.4730038], Jun. 19, 2012, 5 pages.

Mosca, et al.; "Low-Frequency Acoustic Source for AUV Long-Range Communication"; iXSea, France; JAMSTEC, Japan, Jul. 2013, 9 pages.

Gregory W. Heinen, "Modified CO2 Cycle for Long Endurance Unmanned Underwater Vehicles and Resultant Chirp Acoustic Capability", U.S. Appl. No. 15/091,415, filed Apr. 5, 2016.

Gregory W. Heinen et al., "Apparatus and Method for Periodically Charging Ocean Vessel or Other System Using Thermal Energy Conversion", U.S. Appl. No. 15/173,178, filed Jun. 3, 2016.

International Search Report and Written Opinion of the International Search Authority for PCT Patent Application No. PCT/US2017/016976 dated Feb. 12, 2018, 18 pages.

International Search Report and Written Opinion of the International Searching Authority for International Patent Application No. PCT/US2017/017499 dated May 29, 2017, 13 pages.

* cited by examiner

APPARATUS AND METHOD FOR PERIODICALLY CHARGING OCEAN VESSEL OR OTHER SYSTEM USING THERMAL ENERGY CONVERSION

TECHNICAL FIELD

This disclosure generally relates to power supplies for ocean vessels or other systems. More specifically, this disclosure relates to an apparatus and method for periodically charging an ocean vessel or other system using thermal energy conversion.

BACKGROUND

Unmanned underwater vehicles (UUVs) can be used in a number of applications, such as undersea surveying, recovery, or surveillance operations. However, supplying adequate power to UUVs for prolonged operation can be problematic. For example, one prior approach simply tethers a UUV to a central power plant and supplies power to the UUV through the tether. However, this clearly limits the UUV's range and deployment, and it can prevent the UUV from being used in situations requiring independent or autonomous operation. Another prior approach uses expanding wax based on absorbed heat to generate power, but this approach provides power in very small amounts, typically limited to less than about 200 Watts (W) at a 2.2 Watt-hour (WHr) capacity. Yet another prior approach involves using fuel cells in a UUV to generate power, but fuel cells typically require large packages and substantial space.

SUMMARY

This disclosure provides an apparatus and method for periodically charging an ocean vessel or other system using thermal energy conversion.

In a first embodiment, an apparatus includes multiple tanks each configured to receive and store a liquid refrigerant under pressure. The apparatus also includes one or more insulated water jackets each configured to receive and retain water around at least part of an associated one of the tanks. The apparatus further includes at least one generator configured to receive a flow of the liquid refrigerant and to generate electrical power based on the flow of the liquid refrigerant. The apparatus also includes one or more first valves configured to control the flow of the liquid refrigerant between the tanks and through the at least one generator. In addition, the apparatus includes one or more second valves configured to control a flow of the water into and out of the one or more insulated water jackets.

In a second embodiment, a system includes a vessel having a body and fins projecting from the body. The vessel also includes a thermal energy conversion system. The thermal energy conversion includes multiple tanks each configured to receive and store a liquid refrigerant under pressure. The thermal energy conversion system also includes one or more insulated water jackets each configured to receive and retain water around at least part of an associated one of the tanks. The thermal energy conversion system further includes at least one generator configured to receive a flow of the liquid refrigerant and to generate electrical power based on the flow of the liquid refrigerant. The thermal energy conversion system also includes one or more first valves configured to control the flow of the liquid refrigerant between the tanks and through the at least one generator. The thermal energy conversion system further includes one or more second valves configured to control a flow of the water into and out of the one or more insulated water jackets. In addition, the vessel includes a controller configured to control the first and second valves.

In a third embodiment, a method includes receiving and storing a liquid refrigerant under pressure in at least one of multiple tanks. The method also includes receiving and retaining water around at least part of one or more of the tanks using one or more insulated water jackets. The method further includes creating a flow of the liquid refrigerant between the tanks, where the flow is created at least in part based on a pressure differential between the tanks. The method also includes generating electrical power based on the flow of the liquid refrigerant using at least one generator. The method further includes controlling the flow of the liquid refrigerant between the tanks and through the at least one generator using one or more first valves. In addition, the method includes controlling a flow of the water into and out of the one or more insulated water jackets using one or more second valves.

Other technical features may be readily apparent to one skilled in the art from the following figures, descriptions, and claims.

BRIEF DESCRIPTION OF THE DRAWINGS

For a more complete understanding of this disclosure, reference is made to the following description, taken in conjunction with the accompanying drawings, in which.

DETAILED DESCRIPTION

FIGS. 1 through 11, described below, and the various embodiments used to describe the principles of the present invention in this patent document are by way of illustration only and should not be construed in any way to limit the scope of the invention. Those skilled in the art will understand that the principles of the present invention may be implemented in any type of suitably arranged device or system.

FIGS. 1A through 1D illustrate a first example vessel 100 that is periodically charged using thermal energy conversion in accordance with this disclosure. In this example, the vessel 100 denotes an unmanned underwater vehicle or other device that can function as both a buoy and a glider within an ocean or other body of water. The vessel 100 could be used to support various functions, such as undersea surveying, recovery, or surveillance operations.

Figure 1A:
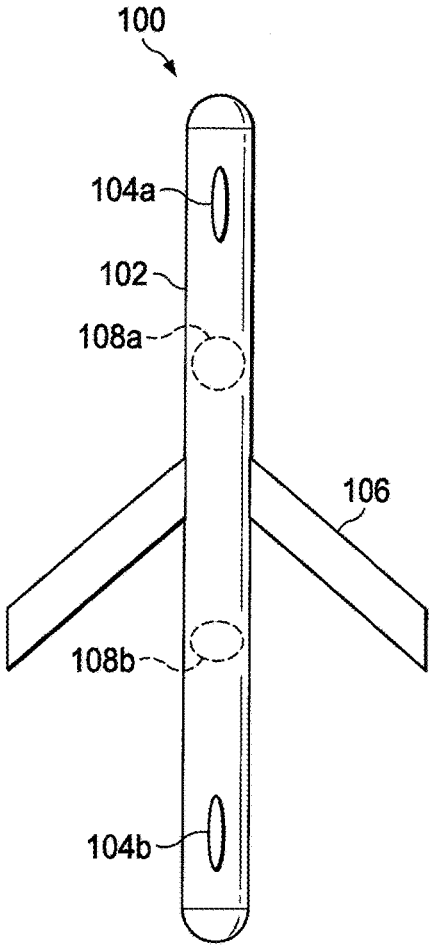
FIGS. 1A through 1D illustrate a first example vessel that is periodically charged using thermal energy conversion in accordance with this disclosure.
Figure 1B:
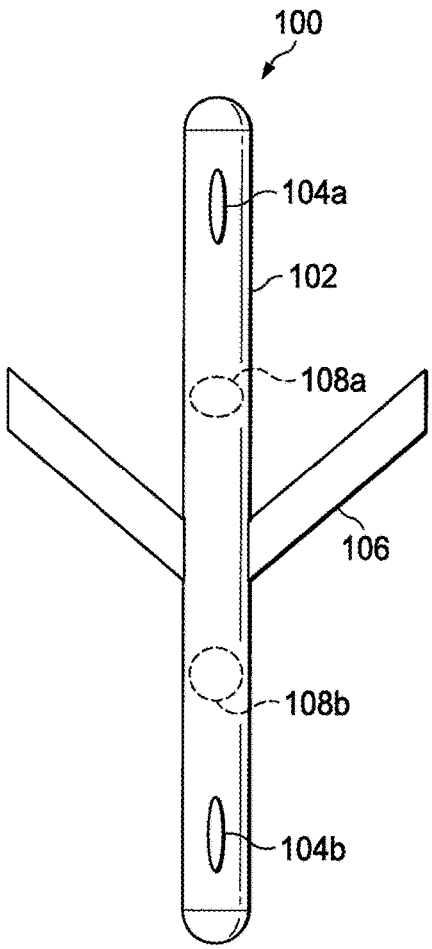

As shown in FIGS. 1A and 1B, the vessel 100 includes a body 102 having fins 104*a*-104*b* and wings 106. The body 102 denotes any suitable structure configured to encase, protect, or otherwise contain other components of the vessel 100. The body 102 could be formed from any suitable material(s) and in any suitable manner. The body 102 can be formed so that the vessel 100 is able to withstand extremely elevated pressures found at deep depths in an ocean or other body of water. In some embodiments, the body 102 could allow the vessel 100 to operate at depths of up to 1,000 meters or more.

The fins 104*a*-104*b* denote projections from the body 102 that help to stabilize the body 102 during travel. Each of the fins 104*a*-104*b* could be formed from any suitable material(s) and in any suitable manner. Also, each of the fins 104*a*-104*b* could have any suitable size, shape, and dimensions. Further, at least some of the fins 104*a*-104*b* could be movable or adjustable to help alter the course of the body 102 and to steer the body 102 through water during travel. In addition, the numbers and positions of the fins 104*a*-104*b* shown here are examples only, and any numbers and positions of fins could be used to support desired operations of the vessel 100.

As described below, the vessel 100 can both ascend and descend within a body of water during use. In some embodiments, the fins 104*a* could be used to steer the vessel 100 while ascending, and the fins 104*b* could be used to steer the vessel 100 while descending. Moreover, when the vessel 100 is ascending, the fins 104*a* can be used to control the pitch of the vessel 100, and a differential between the fins 104*a* can be used to control the roll of the vessel 100. Similarly, when the vessel 100 is descending, the fins 104*b* can be used to control the pitch of the vessel 100, and a differential between the fins 104*b* can be used to control the roll of the vessel 100.

The wings 106 support gliding movement of the vessel 100 underwater. The wings 106 are moveable to support different directions of travel. For example, the wings 106 are swept downward in FIG. 1A when the vessel 100 is ascending, and the wings 106 are swept upward in FIG. 1B when the vessel 100 is descending. In this way, the wings 106 help to facilitate easier or more rapid movement of the vessel 100 while ascending or descending. Each of the wings 106 could be formed from any suitable material(s) and in any suitable manner. Also, each of the wings 106 could have any suitable size, shape, and dimensions. In addition, the number and positions of the wings 106 shown here are examples only, and any number and positions of wings could be used to support desired operations of the vessel 100.

The vessel 100 may further include one or more ballasts 108*a*-108*b*, each of which denotes a mass or other structure that helps to control the center of gravity of the vessel 100. As described in more detail below, material can move within a power supply of the vessel 100, and that movement can alter the center of gravity of the vessel 100. Underwater gliders can be particularly susceptible to changes in their centers of gravity, so the vessel 100 can adjust one or more of the ballasts 108*a*-108*b* as needed or desired (such as during ascent or descent) to maintain the center of gravity of the vessel 100 substantially at a desired location. In some embodiments, the ballasts 108*a*-108*b* are located on opposite sides of the vessel's power supply along a length of the vessel 100. Each ballast 108*a*-108*b* includes any suitable structure configured to modify the center of gravity of a vessel. Note that the number and positions of the ballasts 108*a*-108*b* shown here are examples only, and any number and positions of ballasts could be used in the vessel 100.

Figure 1C:
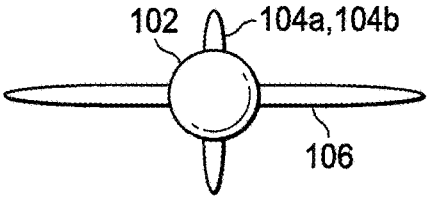
Figure 1D:
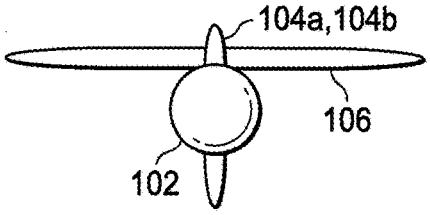

FIGS. 1C and 1D illustrate different possible end views of the vessel 100. In FIG. 1C, the wings 106 are positioned and extend from the body 102 along a line through a center of the body 102. In FIG. 1D, the wings 106 are positioned and extend from the body 102 along a line tangential to the body 102. In either case, the wings 106 can be stowed in a folded position where the wings 106 extend along the length of the body 102 and later unfolded before, during, or after deployment.

Figure 2A:
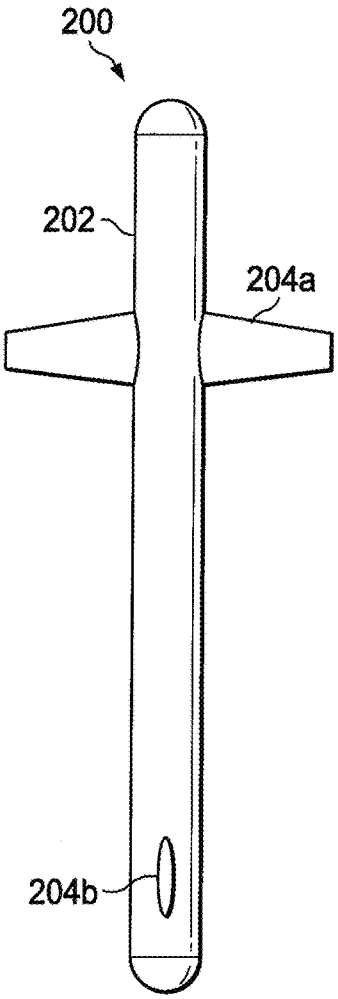
FIGS. 2A through 2C illustrate a second example vessel that is periodically charged using thermal energy conversion in accordance with this disclosure.
Figure 2B:
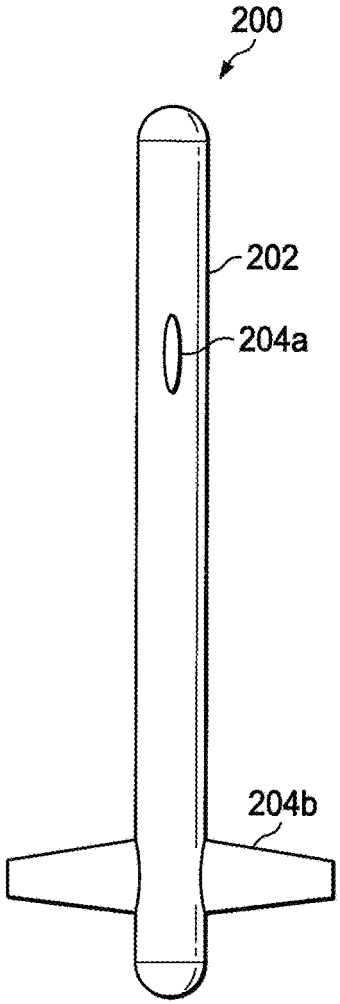
Figure 2C:
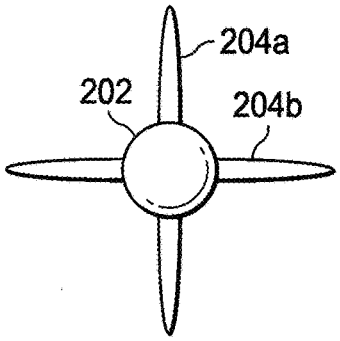

FIGS. 2A through 2C illustrate a second example vessel 200 that is periodically charged using thermal energy conversion in accordance with this disclosure. In this example, the vessel 200 denotes an unmanned underwater vehicle or other device that can function as a buoy within an ocean or other body of water. The vessel 200 could be used to support various functions, such as undersea surveying, recovery, or surveillance operations.

As shown in FIGS. 2A through 2C, the vessel 200 includes a body 202 and fins 204*a*-204*b*. The body 202 denotes any suitable structure configured to encase, protect, or otherwise contain other components of the vessel 200. The body 202 could be formed from any suitable material(s) and in any suitable manner. The fins 204*a*-204*b* denote projections from the body 202 that help to stabilize the body 202 during travel. Each of the fins 204*a*-204*b* could be formed from any suitable material(s) and in any suitable manner. Also, each of the fins 204*a*-204*b* could have any suitable size, shape, and dimensions. Further, at least some of the fins 204*a*-204*b* could be movable or adjustable to help alter the course of the body 202 and to steer the body 102 through water during travel. In addition, the numbers and positions of the fins 204*a*-204*b* shown here are examples only, and any numbers and positions of fins could be used to support desired operations of the vessel 200.

As can be seen in FIGS. 2A through 2C, the vessel 200 lacks wings used to support gliding of the vessel 200 through water. As a result, the vessel 200 denotes a device that can function as a buoy but generally not as a glider within an ocean or other body of water.

In some embodiments, each vessel 100 or 200 shown in FIGS. 1A through 2C could remain generally vertical during normal operation. In this configuration, the vessel 100 or 200 is generally operating as a buoy and can collect information or perform other tasks. Of course, exact vertical orientation is not required during operation of the vessel 100 or 200. During movement up and down within a body of water, the vessel 100 or 200 can travel through the water to the surface or to a desired depth of the water. While submerged, the vessel 100 or 200 could perform operations such as capturing various sensor measurements or searching for anomalies. The periodic surfacing of the vessel 100 or 200 may allow the vessel 100 or 200 to (among other things) transmit and receive data, verify its current location, and perform operations needed for power generation. After each surfacing, the vessel 100 or 200 can re-submerge and, if needed, travel at an angle to a desired depth. The angle of travel may be based on the current location of the vessel 100 or 200 and its desired location, which may allow the vessel 100 or 200 to operate continuously or near-continuously at a desired station.

As described in more detail below, devices such as the vessels 100 and 200 can include a system that supports periodic charging using thermal energy conversion. In particular, the periodic charging system can operate based on different water temperatures that the vessels 100 and 200 experience over their courses of travel. A vessel 100 or 200 could, for example, periodically rise to or near the surface of a water body to collect warmer water and then dive to a desired depth to collect colder water. Differences between the warmer collected water and the colder collected water can be used to generate electrical power for the vessel 100 or 200 or for external devices or systems. As a specific example, a vessel 100 or 200 could use liquid or gaseous carbon dioxide as a refrigerant to drive at least one turbine that generates electrical power for the vessel 100 or 200. Additional details regarding example implementations of periodic charging systems are provided below.

Although FIGS. 1A through 2C illustrate examples of vessel 100, 200 that are periodically charged using thermal energy conversion, various changes may be made to FIGS. 1A through 2C. For example, these figures illustrate example vessels only, and the periodic charging systems described in this patent document could be used in any other suitable device or system. Also, note that the term "periodic" and its derivatives do not require charging of a vessel at a specific interval but merely that a vessel can be charged repeatedly (possibly although not necessarily at a specific interval).

Figure 3:
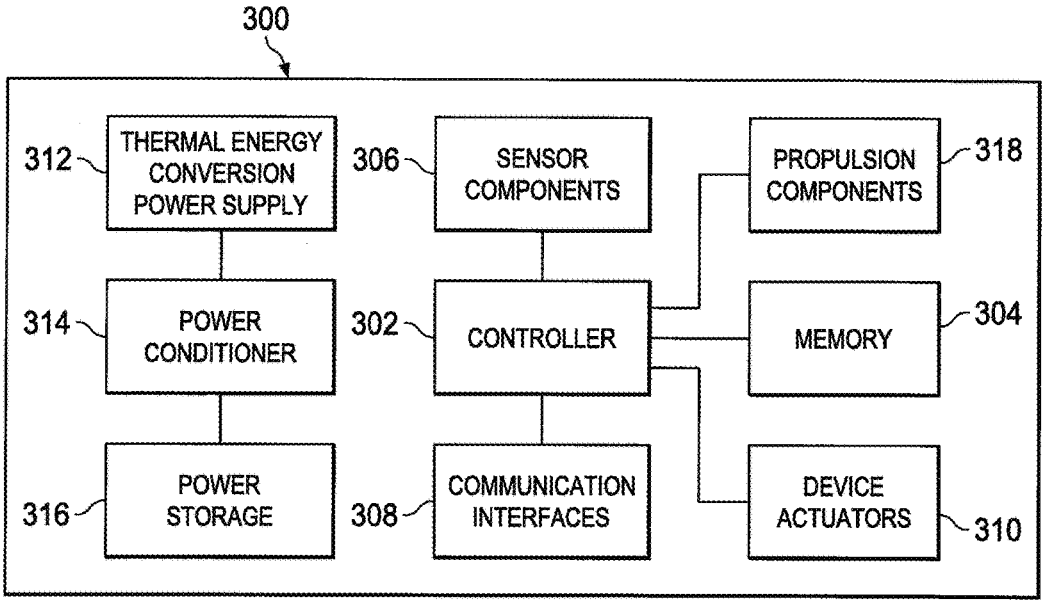
FIG. 3 illustrates example components of a vessel that is periodically charged using thermal energy conversion in accordance with this disclosure.

FIG. 3 illustrates example components of a vessel 300 that is periodically charged using thermal energy conversion in accordance with this disclosure. The vessel 300 could, for example, denote either of the vessels 100 and 200 described above. The components shown in FIG. 3 could therefore denote internal or other components within either of the vessels 100 and 200 that were not shown in FIGS. 1A through 2C.

As shown in FIG. 3, the vessel 300 includes at least one controller 302 and at least one memory 304. The controller 302 controls the overall operation of the vessel 300 and can denote any suitable hardware or combination of hardware and software/firmware for controlling the vessel 300. For example, the controller 302 could denote at least one processor configured to execute instructions obtained from the memory 304. The controller 302 may include any suitable number(s) and type(s) of processors or other computing or control devices in any suitable arrangement. Example types of controllers 302 include microprocessors, microcontrollers, digital signal processors, field programmable gate arrays, application specific integrated circuits, and discrete circuitry.

The memory 304 stores data used, generated, or collected by the controller 302 or other components of the vessel 300. Each memory 304 represents any suitable structure(s) configured to store and facilitate retrieval of information (such as data, program code, and/or other suitable information on a temporary or permanent basis). Some examples of the memory 304 can include at least one random access memory, read only memory, Flash memory, or any other suitable volatile or non-volatile storage and retrieval device(s).

The vessel 300 in this example also includes one or more sensor components 306, one or more communication interfaces 308, and one or more device actuators 310. The sensor components 306 include sensors that could be used to sense any suitable characteristics of the vessel 300 itself or the environment around the vessel 300. For example, the sensor components 306 could include a position sensor, such as a Global Positioning System (GPS) sensor, which can identify the position of the vessel 300. This could be used, for instance, to help make sure that the vessel 300 is following a desired path or is maintaining its position at or near a desired location. The sensor components 306 could also include audio sensors for capturing audio signals, photodetectors or other cameras for capturing video signals or photographs, or any other or additional components for capturing any other or additional information. Each sensor component 306 includes any suitable structure for sensing one or more characteristics.

The communication interfaces 308 support interactions between the vessel 300 and other devices or systems. For example, the communication interfaces 308 could include at least one radio frequency (RF) or other transceiver configured to communicate with one or more satellites, airplanes, ships, or other nearby or distant devices. The communication interfaces 308 allow the vessel 300 to transmit data to one or more external destinations, such as information associated with data collected by the sensor components 306. The communication interfaces 308 also allow the vessel 300 to receive data from one or more external sources, such as instructions for other or additional operations to be performed by the vessel 300 or instructions for controlling where the vessel 300 operates. Each communication interface 308 includes any suitable structure(s) supporting communication with the vessel 300.

The device actuators 310 are used to adjust one or more operational aspects of the vessel 300. For example, the device actuators 310 could be used to move the fins 104*a*-104*b*, 204*a*-204*b* of the vessel while the vessel is ascending or descending. The device actuators 310 could also be used to control the positioning of the wings 106 to control whether the wings 106 are stowed or swept upward or downward (depending on the direction of travel). Each device actuator 310 includes any suitable structure for physically modifying one or more components of a vessel.

The vessel 300 further includes a thermal energy conversion power supply 312, a power conditioner 314, and a power storage 316. The thermal energy conversion power supply 312 generally operates to create electrical energy based on the conversion of thermal energy. In particular, the thermal energy conversion power supply 312 can operate based on different water temperatures that the vessel 300 experiences over the course of its travel. The thermal energy conversion power supply 312 includes any suitable structure configured to generate electrical energy based on thermal differences between materials.

The power conditioner 314 is configured to condition or convert the power generated by the thermal energy conversion power supply 312 into a suitable form for storage or use. For example, the power conditioner 314 could receive a direct current (DC) signal from the thermal energy conversion power supply 312, filter the DC signal, and store power in the power storage 316 based on the DC signal. The power conditioner 314 could also receive power from the power storage 316 and convert the power into suitable voltage(s) and current(s) for other components of the vessel 300. The power conditioner 314 includes any suitable structure(s) for conditioning or converting electrical power.

The power storage 316 is used to store electrical power generated by the thermal energy conversion power supply 312 for later use. The power storage 316 denotes any suitable structure(s) for storing electrical power, such as one or more batteries or super-capacitors.

The vessel 300 further includes one or more propulsion components 318, which denote components used to physically move the vessel 300 through water. The propulsion components 318 could denote one or more motors or other propulsion systems. In some embodiments, the propulsion components 318 could be used only when the vessel 300 is traveling between a position at or near the surface and a desired depth. During other time periods, the propulsion components 318 could be deactivated. Of course, other embodiments could allow the propulsion components 318 to be used at other times, such as to help maintain the vessel 300 at a desired location or to help move the propulsion components 318 to avoid observation or detection.

The power generated by the thermal energy conversion power supply 312 and the power stored in the power storage 316 can be supplied to any of the components in FIG. 3. For example, electrical power could be provided to the controller 302 and memory 304 to facilitate computations and instruction execution by the controller 302 and data storage/retrieval by the memory 304. Electrical power could also be provided to the sensor components 306, communication interfaces 308, and device actuators 310 in order to support sensing, communication, and actuation operations. In addition, electrical power could be provided to the propulsion components 318 in order to support movement of the vessel 300.

Although FIG. 3 illustrates one example of components of a vessel 300 that is periodically charged using thermal energy conversion, various changes may be made to FIG. 3. For example, various components in FIG. 3 could be combined, further subdivided, rearranged, or omitted or additional components could be added according to particular needs.

FIGS. 4 through 7 illustrate a first example type of system for periodically charging a vessel or other system using thermal energy conversion in accordance with this disclosure. In particular, FIGS. 4 through 7 illustrate an example type of system in which liquid transfer supports the generation of electrical power. This type of system could, for example, be implemented as the thermal energy conversion power supply 312 in the vessel 300 of FIG. 3, although this type of system could be used as a thermal energy conversion power supply in any other suitable device or system.

Figure 4:
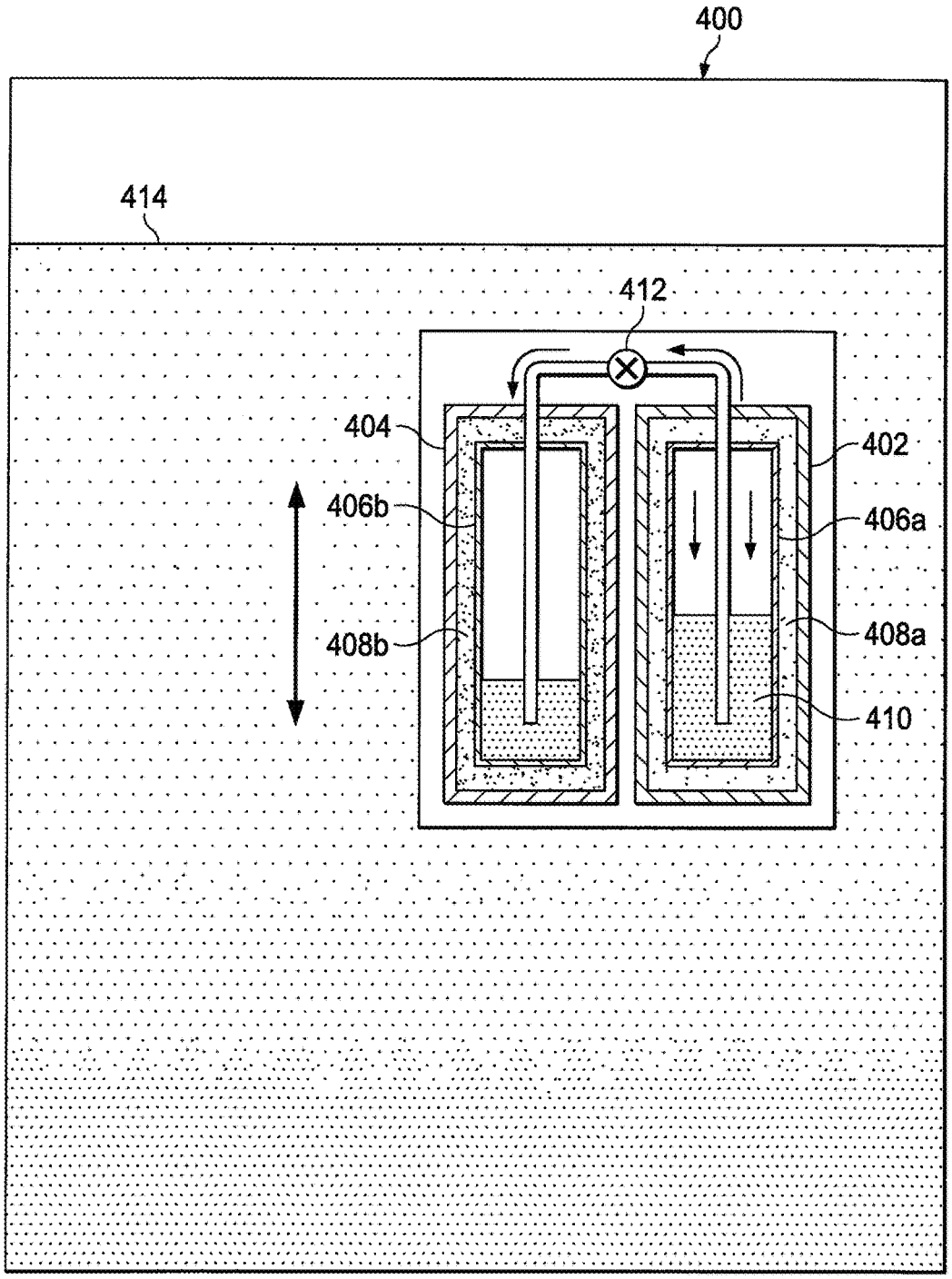
FIGS. 4 through 7 illustrate a first example type of system for periodically charging a vessel or other system using thermal energy conversion in accordance with this disclosure.

As shown in FIG. 4, a system 400 includes multiple insulated tank structures 402-404, which are formed using tanks 406*a*-406*b* and insulated water jackets 408*a*-408*b*. Each tank 406*a*-406*b* is configured to hold a liquid refrigerant 410 under pressure and to provide the liquid refrigerant 410 through a generator 412 to the other tank 406*a*-406*b*. Each tank 406*a*-406*b* includes any suitable structure configured to hold a liquid refrigerant under pressure. Each insulated water jacket 408*a*-408*b* includes any suitable insulated structure configured to receive and retain water. The insulated water jackets 408*a*-408*b* need not be pressurized and can be unpressurized containers. The liquid refrigerant 410 includes any suitable liquid used to transfer heat between the insulated tank structures 402-404, such as liquid carbon dioxide. The generator 412 includes any suitable structure for generating electrical energy based on a flow of liquid, such as a Pelton turbine or a brushless DC (BLDC) generator.

The system 400 can convert thermal energy into electrical energy as follows. The insulated water jacket 408*a* in the insulated tank structure 402 receives and retains warmer water, such as water collected when the vessel 300 is at or near the surface of a body of water 414. The insulated water jacket 408*b* in the insulated tank structure 404 receives and retains colder water, such as water collected after the vessel 300 dives to a desired depth. One or more valves can be used to prevent the flow of the liquid refrigerant 410 while the different waters are being collected.

The warmer water in the insulated water jacket 408*a* heats the liquid refrigerant 410, causing a portion of the liquid refrigerant 410 to evaporate and changing a liquid-to-vapor ratio within the tank 406*a*. This increases the pressure within the tank 406*a*. When the valve(s) is/are opened, the increased pressure within the tank 406*a* begins pushing the liquid refrigerant 410 out of the tank 406*a* and through the generator 412 into the tank 406*b*. The generator 412 generates electrical energy based on the liquid flow through the generator 412. The colder water in the insulated water jacket 408*b* cools the liquid refrigerant 410, keeping the pressure within the tank 406*b* at a lower level. At some point, the valve(s) is/are closed, such as after a large amount of the liquid refrigerant 410 has been transferred to the tank 406*b*. The water in the insulated water jackets 408*a*-408*b* could then be flushed, and the water temperatures can be reversed so that the insulated water jacket 408*a* receives and retains colder water and the insulated water jacket 408*b* receives and retains warmer water.

This process can be repeated any number of times as the vessel 300 moves up and down within the body of water 414. In some embodiments, this process is performed each time the vessel 300 rises to or near the surface of the body and water 414 and each time the vessel 300 dives to a desired depth. For example, the vessel 300 can capture colder water in one of the insulated water jackets 408*a*-408*b* while at a desired depth, and once at or near the surface the vessel 300 can capture warmer water in another of the insulated water jackets 408*a*-408*b* and generate electrical power. The vessel 300 can also capture warmer water in one of the insulated water jackets 408*a*-408*b* while at or near the surface, and once at a desired depth the vessel 300 can capture colder water in another of the insulated water jackets 408*a*-408*b* and generate electrical power. Note, however, that the vessel 300 could also be configured to generate electrical power only in certain circumstances, such as when at a desired depth under the water to help avoid prolonged exposure at or near the water's surface. In whatever manner it occurs, this approach effectively allows thermal energy to be extracted from the warmer water in the insulated water jackets 408*a*-408*b* and to be provided to the colder water in the insulated water jackets 408*a*-408*b*, and in the process electrical energy for the vessel 300 is generated.

Figure 5A:
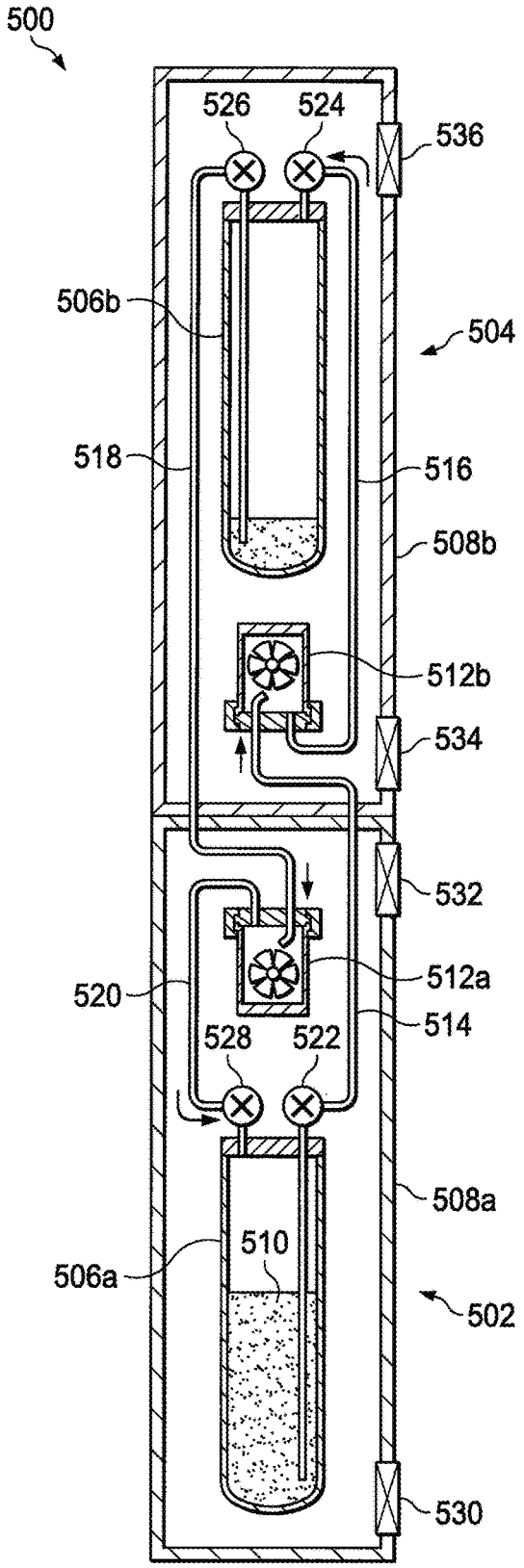
Figure 5B:
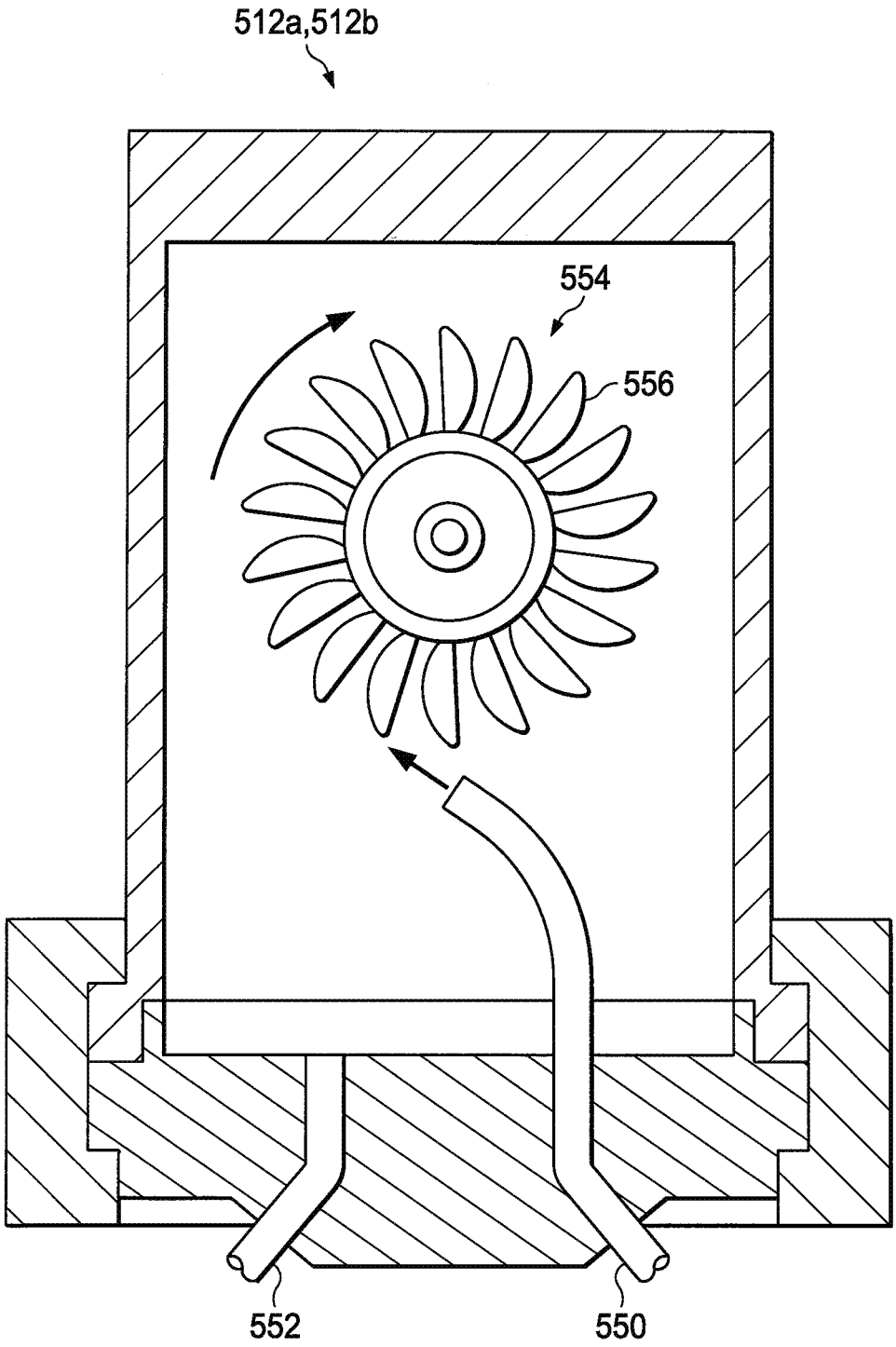

FIGS. 5A and 5B illustrate a system 500 denoting a specific implementation of the system 400 in greater detail. As shown in FIG. 5A, the system 500 includes multiple insulated tank structures 502-504, which are formed using tanks 506*a*-506*b* and insulated water jackets 508*a*-508*b*. Each tank 506*a*-506*b* is configured to hold a liquid refrigerant 510 under pressure and to provide the liquid refrigerant 510 through one of multiple generators 512*a*-512*b* to the other tank 506*a*-506*b*. Each of these components could be the same as or similar to the corresponding components in FIG. 4. As shown here, the insulated tank structures 502-504 are arranged end-to-end, although they could be placed in any other suitable arrangement (such as side-by-side). In some embodiments, the insulated tank structures 502-504 can be positioned around the center of gravity of the vessel 300.

Conduits 514-520 provide passageways for the liquid refrigerant 510 to travel through the system 500. For example, when the insulated water jacket 508*a* contains warmer water and the insulated water jacket 508*b* contains colder water, the liquid refrigerant 510 can travel from the tank 506*a* via the conduit 514 to the generator 512*b* and then to the tank 506*b* via the conduit 516. When the insulated water jacket 508*b* contains warmer water and the insulated water jacket 508*a* contains colder water, the liquid refrigerant 510 can travel from the tank 506*b* via the conduit 518 to the generator 512*a* and then to the tank 506*a* via the conduit 520. Each conduit 514-520 denotes any suitable passageway for a liquid refrigerant. Each conduit 514-520 could be formed from any suitable material(s) and in any suitable manner.

Valves 522-528 are used to control the flow of the liquid refrigerant 510 through the conduits 514-520. For example, the valve 522 controls whether the liquid refrigerant 510 can exit the tank 506*a* and travel to the generator 512*b* through the conduit 514, and the valve 524 controls whether the liquid refrigerant 510 can travel from the generator 512*b* and enter the tank 506*b* through the conduit 516. Similarly, the valve 526 controls whether the liquid refrigerant 510 can exit the tank 506*b* and travel to the generator 512*a* through the conduit 518, and the valve 528 controls whether the liquid refrigerant 510 can travel from the generator 512*a* and enter the tank 506*a* through the conduit 520. Each valve 522-528 denotes any suitable structure for controlling the flow of a liquid refrigerant, such as a needle valve.

Additional valves 530-536 are included in the insulated water jackets 508*a*-508*b* to control the flow of fresh water into and out of the insulated water jackets 508*a*-508*b*. For example, when the vessel 300 is located at or near the surface of a body of water, two of the valves 530-532 or 534-536 could be opened so that fresh warmer water can be drawn into one of the insulated water jackets 508*a*-508*b*. When the vessel 300 is located at a desired depth underwater, the other two valves 534-536 or 530-532 could be opened so that fresh colder water can be drawn into the other of the insulated water jackets 508*a*-508*b*. Although not shown, pumps or other mechanisms can be used to help pull water into or push water out of the insulated water jackets 508*a*-508*b*. Also, although not shown, a water brake ram could be used to slow a vehicle's ascent or descent using water contained in the water jacket to be flushed. Each valve 530-536 denotes any suitable structure for controlling the flow of water into or out of an insulated water jacket.

The various valves 522-536 shown in FIG. 5 could be controlled in any suitable manner. For example, in some embodiments, the controller 302 of a vessel 300 could control the valves 522-536 as part of the overall control of the vessel 300.

FIG. 5B illustrates one specific implementation of the generators 512*a*-512*b*. In this example, each generator 512*a*-512*b* includes an inlet 550, an outlet 552, and a generator mask 554. The inlet 550 receives the liquid refrigerant 510 from an external source, such as a tank 506*a*-506*b*. The liquid refrigerant 510 passes through the generator mask 554 and turns a turbine. The outlet 552 then receives the liquid refrigerant 510 and allows the liquid refrigerant 510 to exit the generator 512*a*-512*b*. The generator mask 554 represents part of a Pelton turbine, BLDC generator, or other turbine and includes orifices 556 having a desired size, such as from about 0.01 to about 0.02 inches in width. BLDC generators can often achieve efficiencies of about 85% or more, while a Pelton turbine can often achieve efficiencies of about 90% or more. Each generator 512*a*-512*b* can be easily throttled by controlling the flow of the liquid refrigerant 510 using the appropriate valves 522-528.

In this approach, the system 500 is a sealed system with respect to the liquid refrigerant 510. The tanks 506*a*-506*b*, generators 512*a*-512*b*, conduits 514-520, and valves 522-528 are sealed so that little or no liquid refrigerant 510 escapes from the system 500 over time.

Figure 6A:
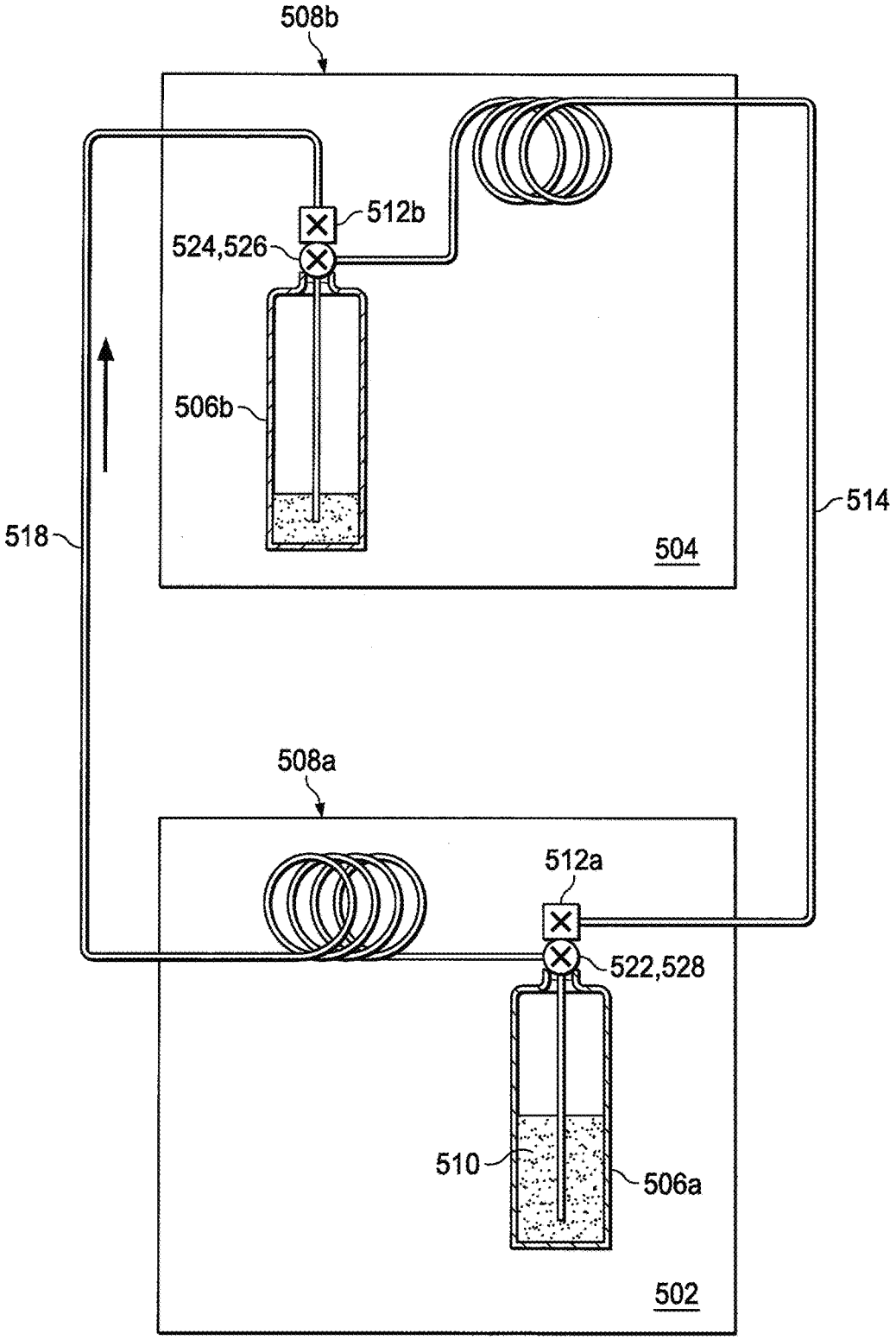
Figure 6B:
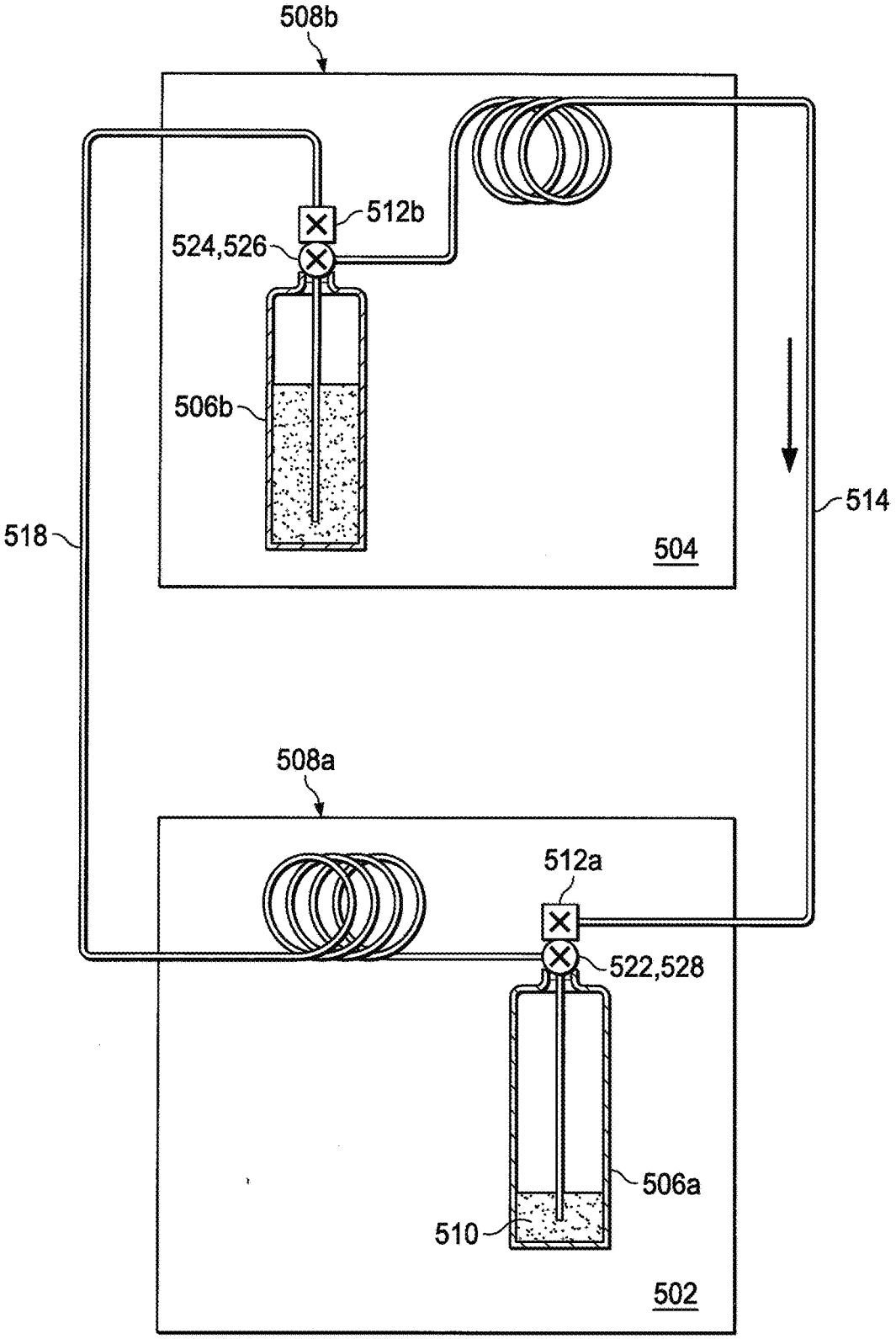

FIGS. 6A and 6B illustrate example operations of the system 500. In FIG. 6A, the insulated water jacket 508*a* contains warmer water, while the insulated water jacket 508*b* contains colder water. When the appropriate valves 522 and 524 are opened, the liquid refrigerant 510 flows from the tank 506*a* through the generator 512*b* into the tank 506*b*. Once electrical generation is completed, the valves 522 and 524 are closed, and the water in the insulated water jackets 508*a*-508*b* is replaced. In FIG. 6B, the insulated water jacket 508*a* contains colder water, while the insulated water jacket 508*b* contains warmer water. When the appropriate valves 526 and 528 are opened, the liquid refrigerant 510 flows from the tank 506*b* through the generator 512*a* into the tank 506*a*.

The amount of power generated using the system 500 can vary depending on a number of parameters in the system 500. In one particular implementation of the system 500, one of the tanks 506*a*-506*b* can be heated to a temperature of about 25° C., creating a pressure of about 995 pounds per square inch (psi) within the tank. Another of the tanks 506*a*-506*b* can be cooled to a temperature of about 5° C., creating a pressure of about 550 psi within the tank. The liquid refrigerant 510 is siphon fed from the warmer tank to the colder tank at a differential pressure of about 400 psi. With orifices 556 (shown in FIG. 5B) of about 0.012 to about 0.015 inches in the generators 512*a*-512*b*, the liquid refrigerant 510 could pass through the appropriate generator 512*a* or 512*b* at a speed of up to 800 meters per second or more. The pressures equalize in the tanks 506*a*-506*b* after about 75% of the liquid refrigerant 510 is transferred from one tank to the other tank. At that point, the appropriate valves 522-528 can be closed, the water in the insulated water jackets 508*a*-508*b* can be replaced, and the process can be repeated. In particular embodiments, a single cycle of the system 500 could generate more than 250 kJ of energy at a capacity of about 37 Watt-hours (WHr) to about 92 WHr. Of course, other embodiments of the system 500 could operate under different conditions and generate different amounts of power.

Figure 7:
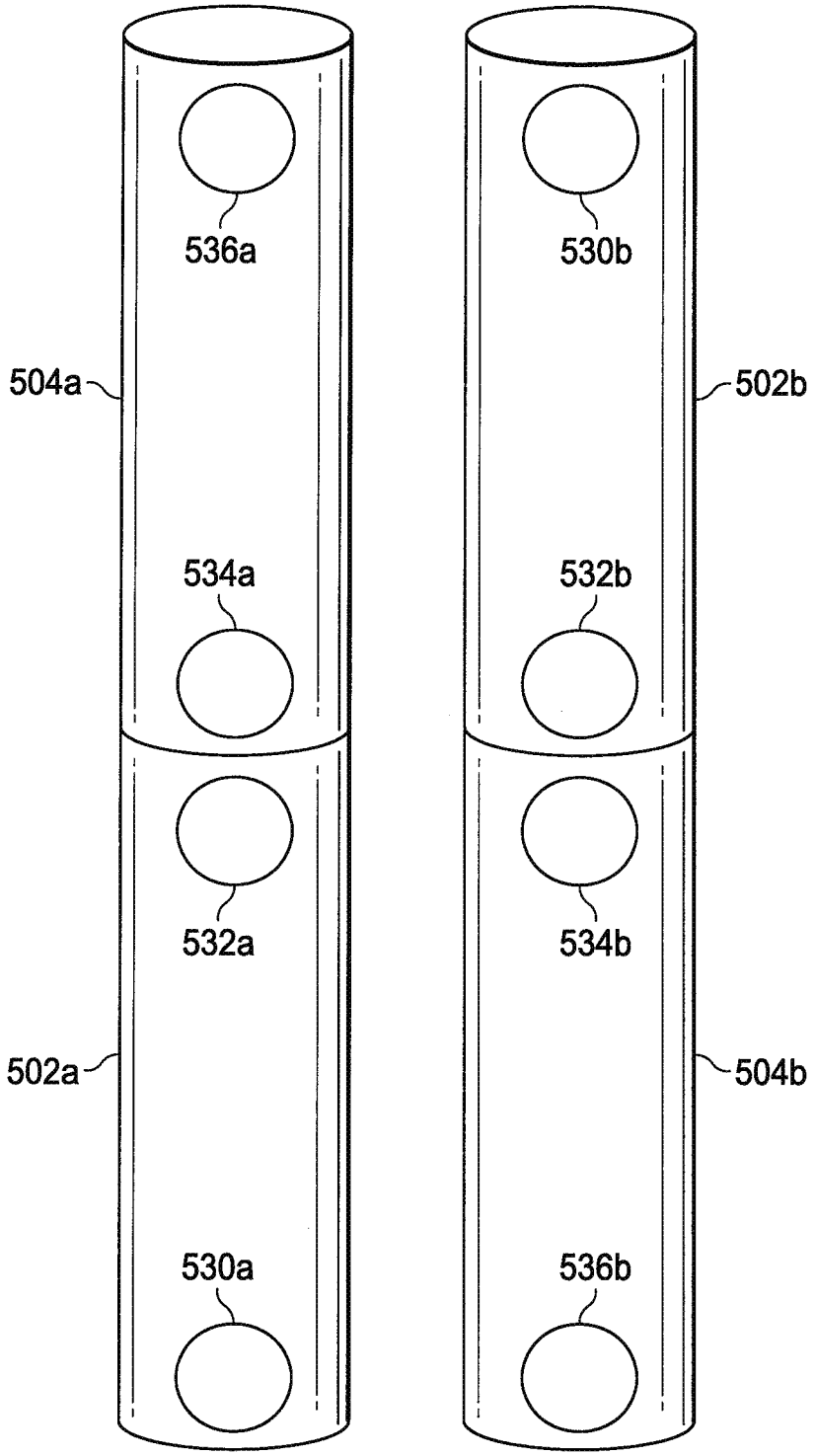

It is also possible to replicate the system 500 any number of times to increase the power generation capabilities of the system 500. For example, FIG. 7 illustrates two subsystems formed using different instances of the system 500 placed side-by-side, where the overall system includes two pairs of insulated tank structures 502*a*, 504*a* and 502*b*, 504*b*. The insulated tank structures 502*a*, 504*a* and 502*b*, 504*b* are shown with various valves 530*a*-536*a*, 530*b*-536*b* used to flush and replace the water contained in the insulated tank structures 502*a*, 504*a* and 502*b*, 504*b*. Note that while shown as side-by-side, other arrangements such as end-to-end could also be used.

In FIG. 7, the arrangement of the insulated tank structures 502*a*, 504*a* can be inverted compared to the insulated tank structures 502*b*, 504*b*. As a result, liquid refrigerant 510 in the insulated tank structures 502*a*, 504*a* can flow in the opposite direction compared to the flow of liquid refrigerant 510 in the insulated tank structures 502*b*, 504*b*. This arrangement can help to at least partially offset changes to a vessel's center of gravity since the flow of liquid refrigerant 510 in one direction is substantially or completely offset by the flow of liquid refrigerant 510 in the opposite direction. While two instances of the system 500 are shown in FIG. 7, more than two instances of the system 500 could be used in a particular installation, and those instances of the system 500 could be placed in any suitable configuration.

Although FIGS. 4 through 7 illustrate a first example type of system for periodically charging a vessel or other system using thermal energy conversion, various changes may be made to FIGS. 4 through 7. For example, various components in each figure could be combined, further subdivided, rearranged, or omitted or additional components could be added according to particular needs.

Figure 8:
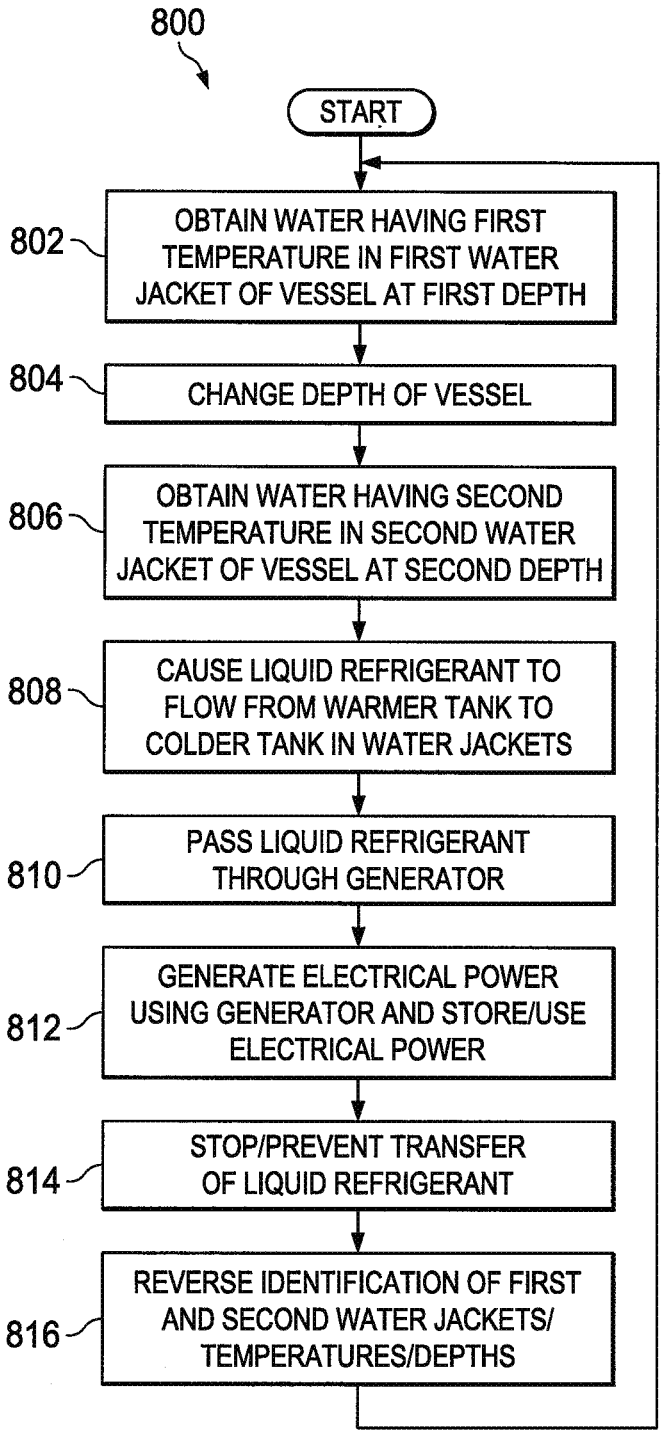
FIG. 8 illustrates a first example method for periodically charging a vessel or other system using thermal energy conversion in accordance with this disclosure.

FIG. 8 illustrates a first example method 800 for periodically charging a vessel or other system using thermal energy conversion in accordance with this disclosure. For ease of explanation, the method 800 is described with respect to the system 500 operating in the vessel 300. However, the method 800 could be used in any other suitable device or system.

As shown in FIG. 8 and referring to components described in FIGS. 3-7, water having a first temperature is obtained in a first water jacket of a vessel when the vessel is at a first depth at step 802. This could include, for example, the controller 302 of the vessel 300 opening the valves 530-532 to capture warmer or colder water (depending on the depth) into the insulated water jacket 508*a*. The depth of the vessel changes at step 804. This could include, for example, the controller 302 of the vessel 300 controlling the propulsion components 318 so that the vessel 300 ascends to be at or near the surface of a body of water or to dive to a desired depth. Water having a second temperature is obtained in a second water jacket of the vessel when the vessel is at a second depth at step 806. This could include, for example, the controller 302 of the vessel 300 opening the valves 534-536 to capture colder or warmer water (depending on the depth) into the insulated water jacket 508*b*.

Liquid refrigerant flows from a tank in the water jacket containing the warmer water to a tank in the water jacket containing the colder water at step 808. This could include, for example, the controller 302 of the vessel 300 opening the valves 522-524 or the valves 526-528 to open a fluid passageway between the tanks 506*a*-506*b*. The higher temperature in the water jacket containing the warmer water causes a liquid-to-vapor ratio within the warmer tank 506*a* or 506*b* to increase, which increases the pressure within that tank and pushes the liquid refrigerant 510 out of that tank. The liquid refrigerant passes through a generator as it travels from one tank to the other tank at step 810. This could include, for example, passing the liquid refrigerant 510 through the generator 512*a* or 512*b*. Electrical power is generated by the generator and stored or used at step 812. This could include, for example, the generator 512*a* or 512*b* generating DC power based on the refrigerant flow, and the DC power can be provided to the power conditioner 314 and stored in the power storage 316 or used by the vessel 300.

The transfer of the liquid refrigerant eventually stops or is prevented at step 814. This could include, for example, the controller 302 of the vessel 300 closing the valves 522-524 or the valves 526-528 to close the fluid passageway between the tanks 506*a*-506*b*. This could be done in any suitable manner, such as after a specified amount of time has elapsed, after one or both tanks 506*a*-506*b* hit at least one specified pressure, or in any other suitable manner.

At this point, the identification of the first and second water jackets, temperatures, and depths is reversed at step 816, and the entire method 800 can be repeated. In other words, steps 802-814 can be repeated but with the temperatures within the insulated water jackets 508*a*-508*b* reversed. As a result, the liquid refrigerant 510 can be transferred repeatedly back and forth between the tanks 506*a*-506*b* by reversing the temperatures of the water contained in the insulated water jackets 508*a*-508*b*. As noted above, however, step 816 need not occur, such as when the vessel 300 only generates power after diving to a desired depth and not when located at or near the surface of a body of water. In that case, step 816 could be replaced by the vessel 300 changing its depth to the first depth.

Although FIG. 8 illustrates a first example of a method 800 for periodically charging a vessel or other system using thermal energy conversion, various changes may be made to FIG. 8. For example, while shown as a series of steps, various steps in FIG. 8 could overlap, occur in parallel, occur in a different order, or occur any number of times. As a particular example, steps 808-812 generally overlap during the production of electrical power.

FIGS. 9A through 10D illustrate a second example type of system for periodically charging a vessel or other system using thermal energy conversion in accordance with this disclosure. In particular, FIGS. 9A through 10D illustrate an example system in which gas transfer supports the generation of electrical power. This type of system could, for example, be implemented as the thermal energy conversion power supply 312 in the vessel 300 of FIG. 3, although this type of system could be used as a thermal energy conversion power supply in any other suitable device or system.

Figure 9A:
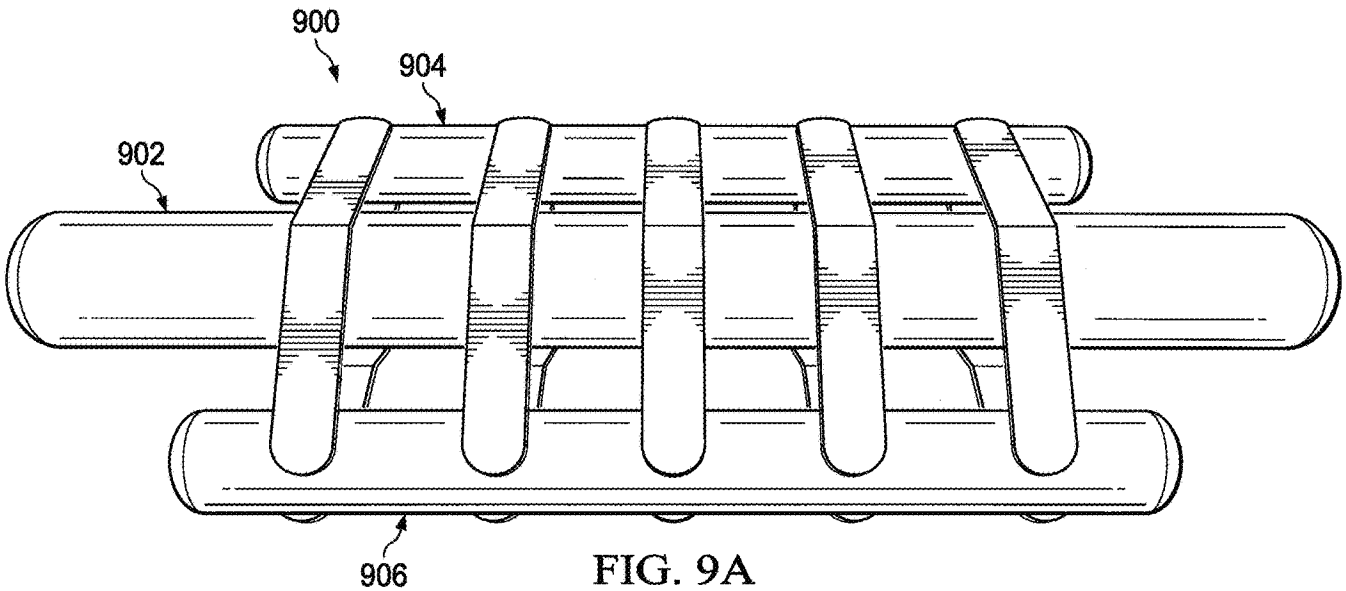
FIGS. 9A through 10D illustrate a second example type of system for periodically charging a vessel or other system using thermal energy conversion in accordance with this disclosure.
Figure 9B:
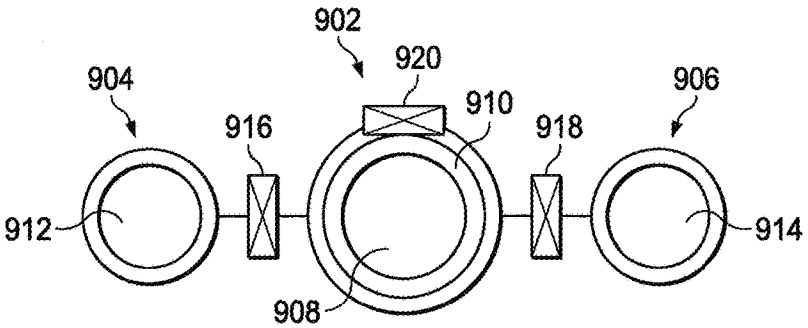

As shown in FIGS. 9A and 9B, the system 900 includes a central insulated tank structure 902 and two outer tank structures 904-906. Note that the terms "central" and "outer" do not impart specific structural requirements on the system 900 and are merely used to distinguish between different tank structures in the figures. The central insulated tank structure 902 could be similar to the insulated tank structures described above and includes a tank 908 with an insulated water jacket 910. The outer tank structures 904-906 include tanks 912-914, respectively, which are not insulated or are insulated to a much smaller degree. Each tank 908, 912, 914 is configured to hold a refrigerant under pressure. In some implementations, the tanks 912-914 could denote annular tanks, which are tanks that store refrigerant in an annular structure rather than a conventional cylindrical structure. The insulated water jacket 910 includes any suitable insulated structure configured to receive and retain water.

As shown in FIG. 9B, valves 916-918 are used to control the flow of refrigerant between the central insulated tank structure 902 and the outer tank structures 904-906. Each valve 916-918 denotes any suitable structure for controlling the flow of a refrigerant, such as a needle valve. Valves 920, possibly along with other components (such as one or more pumps), facilitate replacing the water within the insulated water jacket 910. Each valve 920 denotes any suitable structure for controlling the flow of water into or out of an insulated water jacket.

FIGS. 10A through 10D illustrate additional details of the tank structures 902-906, as well as details of an example operational cycle of the system 900. In these figures, a graph 1002 identifies the location(s) of a refrigerant in the various tank structures 902-906, while a graph 1004 identifies the general location of the vessel 300 within a body of water.

As shown in FIGS. 10A through 10D, the tank 908 in the central insulated tank structure 902 is segmented (such as by annular baffles) and includes multiple valves 1006 connecting the segments. The segments of the tank 908 are fluidly isolated from each other except for passages through the valves 1006. Each of the valves 1006 fluidly couples two adjacent segments of the tank 908, and closing a valve 1006 effectively divides the tank 908 into multiple separated volumes. Similarly, each tank 912-914 in the outer tank structures 904-906 is segmented (such as by annular baffles) and includes multiple valves 1008 connecting the segments. The segments of each tank 912-914 are fluidly isolated from each other except for passages through the valves 1008. Each of the valves 1008 fluidly couples two adjacent segments of a tank 912-914, and closing a valve 1008 effectively divides that tank 912-914 into multiple separated volumes.

As described below, the valves 1006-1008 can be opened and closed to control the volume in which a liquid refrigerant 1010 is stored in the tanks 908, 912, 914. This allows the pressures in the tanks 908, 912, 914 to be controlled in order to support driving at least one generator 1012 in order to generate electrical power. The valves 1006-1008 can also help to prevent sloshing of the liquid refrigerant 1010 in the tanks 908, 912, 914. Uncontrolled sloshing of the liquid refrigerant 1010 could greatly alter the center of gravity in the vessel 300, which as noted above is undesirable in vessels like gliders. In the following discussion, the "effective volume" of a tank refers to the volume of a tank that has not been isolated by the associated valve(s) 1006 or 1008, so liquid refrigerant 1010 in the effective volume of the tank can be used for energy generation purposes. Some amount of liquid refrigerant 1010 may be trapped in an isolated portion of a tank due to closure of a valve 1006 or 1008, although this may not significantly impact energy generation.

Figure 10A:
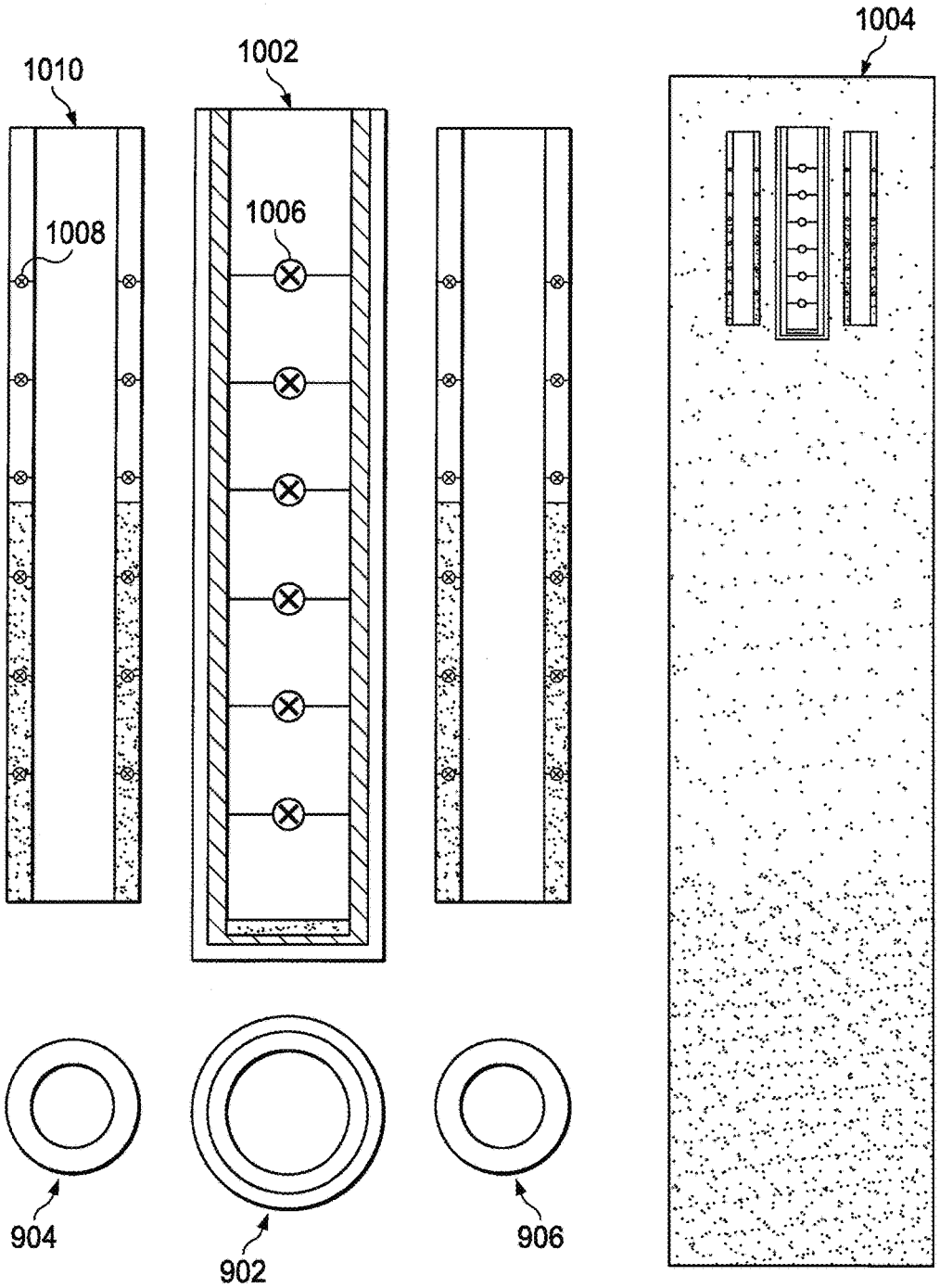

In FIG. 10A, the bulk of the liquid refrigerant 1010 is located within the tanks 912-914 of the outer tank structures 904-906. At the start of this phase of operation, the water in the insulated water jacket 910 of the central insulated tank structure 902 is colder water (such as colder water obtained during an earlier cycle of the system 900), and the system 900 is located at or near the surface of a body of water.

Since the system 900 is located at or near the surface of the body of water, the liquid refrigerant 1010 in the tanks 912-914 of the outer tank structures 904-906 absorb heat and can reach a significantly higher temperature than the colder water in the insulated water jacket 910 of the central insulated tank structure 902. For example, the liquid refrigerant 1010 in the tanks 912-914 could be heated to around 20° C. or more, while the water in the insulated water jacket 910 could remain around 5° C. This raises the pressure significantly within the tanks 912-914 while keeping the pressure within the tank 908 at a lower pressure. One or more valves 1008 could be closed in each tank 912-914 during this heating process so that the effective volume in the tanks 912-914 is almost or completely filled with the liquid refrigerant 1010. Note that the heating of the tanks 912-914 could take a prolonged period of time, such as three to four hours depending on weather and other factors.

Figure 10B:
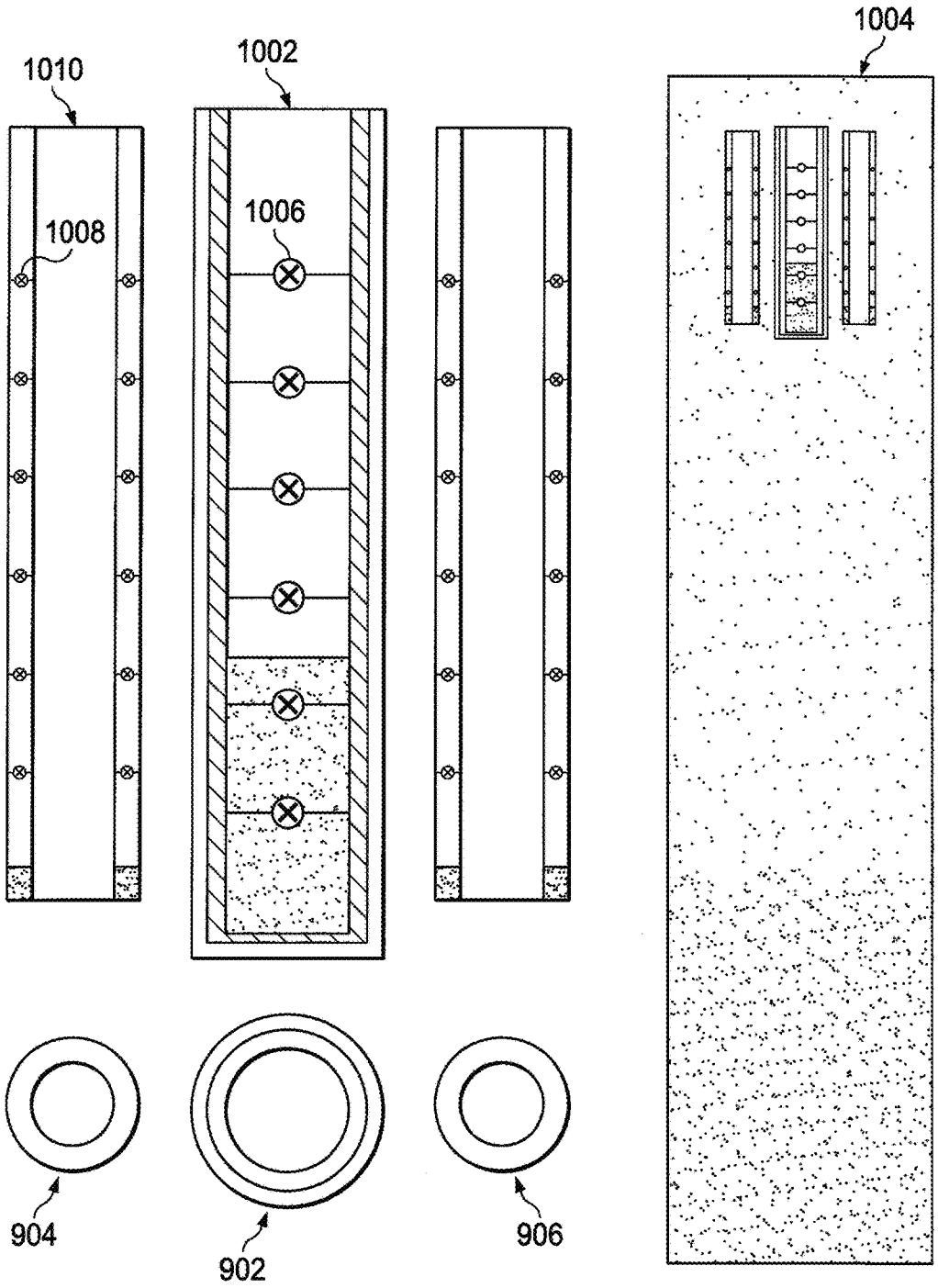

Once the pressure within the tanks 912-914 is sufficiently high, the valves 916-918 are opened. As shown in FIG. 10B, since the pressure within the tank 908 of the central insulated tank structure 902 is lower due to the presence of colder water in the insulated water jacket 910, the refrigerant 1010 transfers into the tank 908. The valves 916 and 918 are then closed to prevent the transfer of the refrigerant 1010 back into the tanks 912-914. At this point, the water in the insulated water jacket 910 is flushed by opening the valves 920 and replaced with warmer water. Once the insulated water jacket 910 contains warmer water, the valves 920 are closed, and the warmer water increases the pressure within the tank 908. Optionally, the vessel 900 may remain at or near the surface of the body of water for an additional time, allowing the pressure within the tank 908 to increase significantly.

Figure 10C:
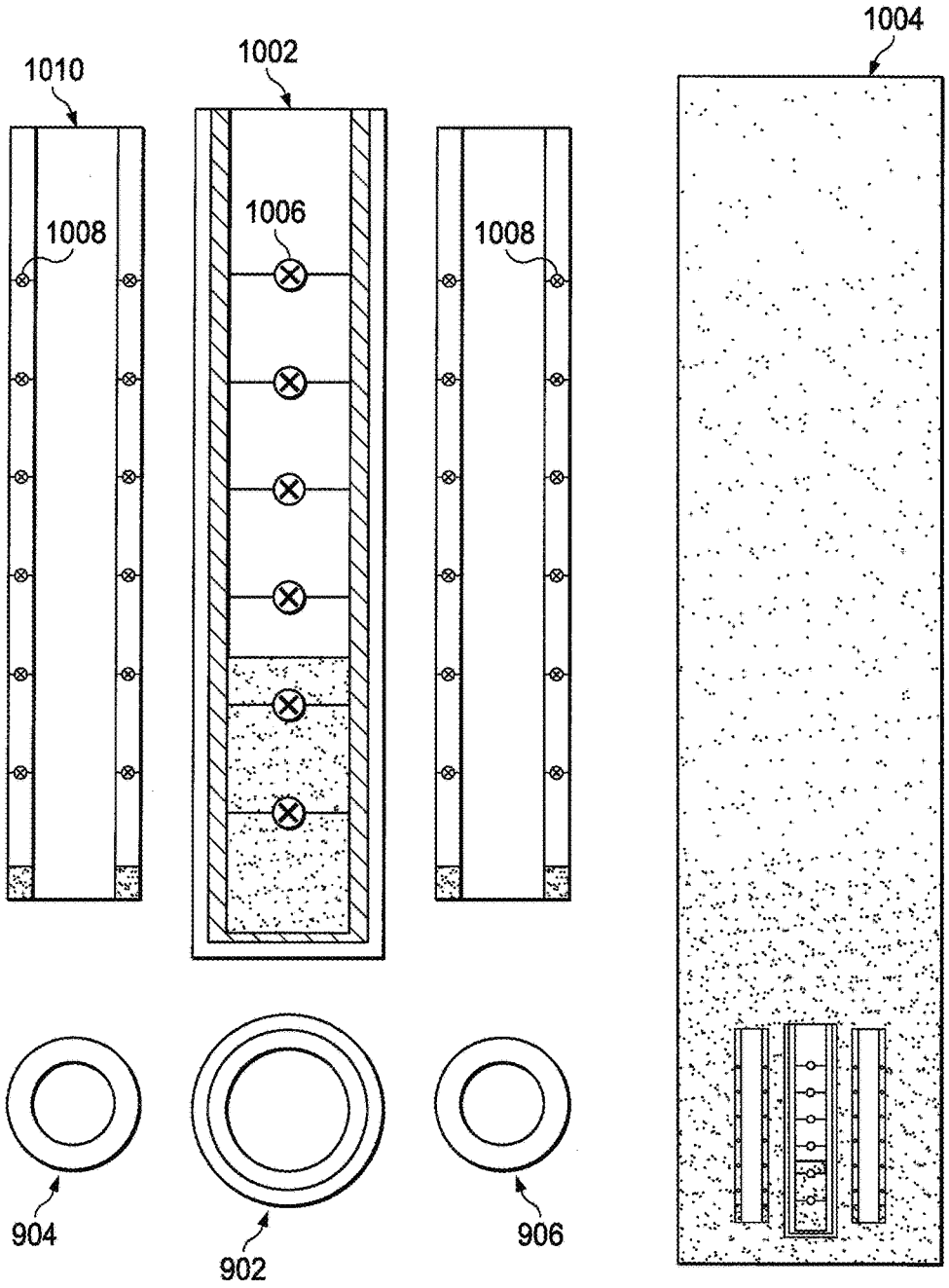

At this point, the vessel 300 dives to a desired depth as shown in FIG. 10C. During and after the dive, the warmer water within the insulated water jacket 910 helps to maintain the refrigerant 1010 in the tank 908 at a higher temperature and pressure, while the colder water in the ambient environment at the lower depths cools the tanks 912-914. One or more valves 1006 can be closed in the tank 908 so that the effective volume in the tank 908 is almost or completely filled with the liquid refrigerant 1010. Also, all of the valves 1008 can be opened so that the tanks 912-914 have a significantly lower pressure compared to the tank 908. In some embodiments, for example, the tank 908 could have a pressure around 800-900 psi, while the tanks 912-914 could have a pressure of around 300 psi.

Figure 10D:
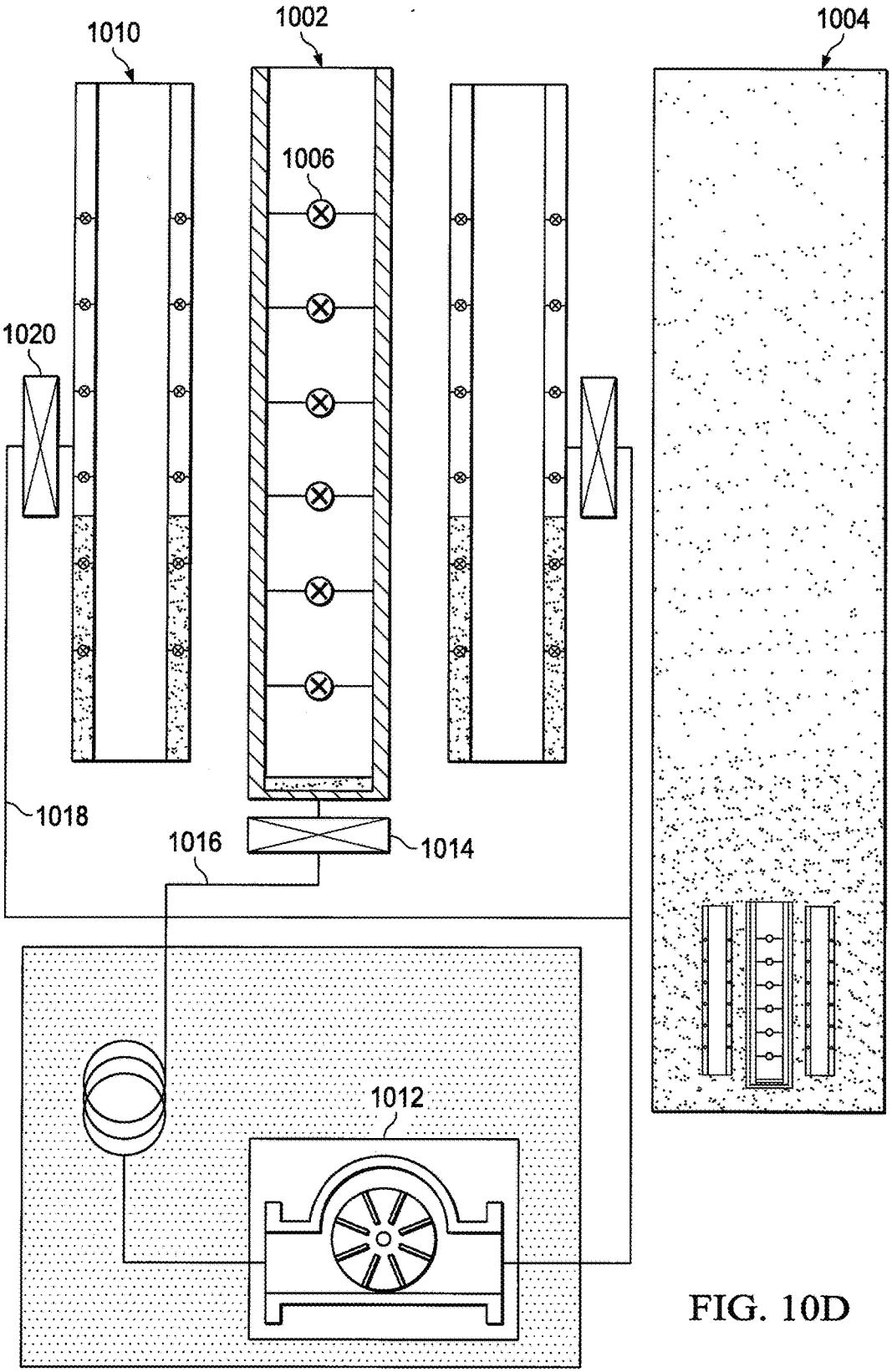

As shown in FIG. 10D, the system 900 then sends the refrigerant 1010 through the generator 1012, which could denote an evaporator and turbine heat exchanger. A valve 1014 can be opened to allow the refrigerant 1010 to pass through a conduit 1016 to the generator 1012, which generates electrical power. Evaporated refrigerant 1010 is supplied via conduits 1018 and valves 1020 to the tanks 912-914, where the colder temperatures of the tanks 912-914 condense the evaporated refrigerant 1010 back into liquid refrigerant 1010. The warmer water in the insulated water jacket 910 can be used to supply additional heat needed for evaporation of the refrigerant 1010. During this phase, opened valves 1006 can close from top to bottom as the level of refrigerant in the tank 906 drops, which helps to maintain the fill percentage and pressure in the tank 908 at a suitable level. The generator 1012 can be used here to generate power, which the power conditioner 314 can condition and store in the power storage 316. Note that this phase could take a prolonged period of time, such as three to four hours.

Once completed, the valves 1014 and 1020 are closed, and the warmer water in the insulated water jacket 910 can be flushed and replaced with colder water. The system 900 can then repeat the process by ascending to or near the surface of the body of water, at which point the phase shown in FIG. 10A can commence again.

Note that the use of the valves 1006-1008 in the tanks 908, 912, 914 is for illustration only and that other mechanisms could be used to control the effective volumes of the tanks. For example, pistons could be used in the tanks 908, 912, 914 to control their effective volumes. Also note that the amount of power generated using the system 900 can vary depending on a number of parameters in the system 900. In one particular implementation of the system 900, a single cycle of the system 900 could generate more than 1.5 kW of power. Of course, other embodiments of the system 900 could operate under different conditions and generate different amounts of power.

Although FIGS. 9A through 10D illustrate a second example type of system for periodically charging a vessel or other system using thermal energy conversion, various changes may be made to FIGS. 9A through 10D. For example, various components in each figure could be combined, further subdivided, rearranged, or omitted or additional components could be added according to particular needs. As a particular example, a single outer tank structure or more than two outer tank structures could be used.

Figure 11:
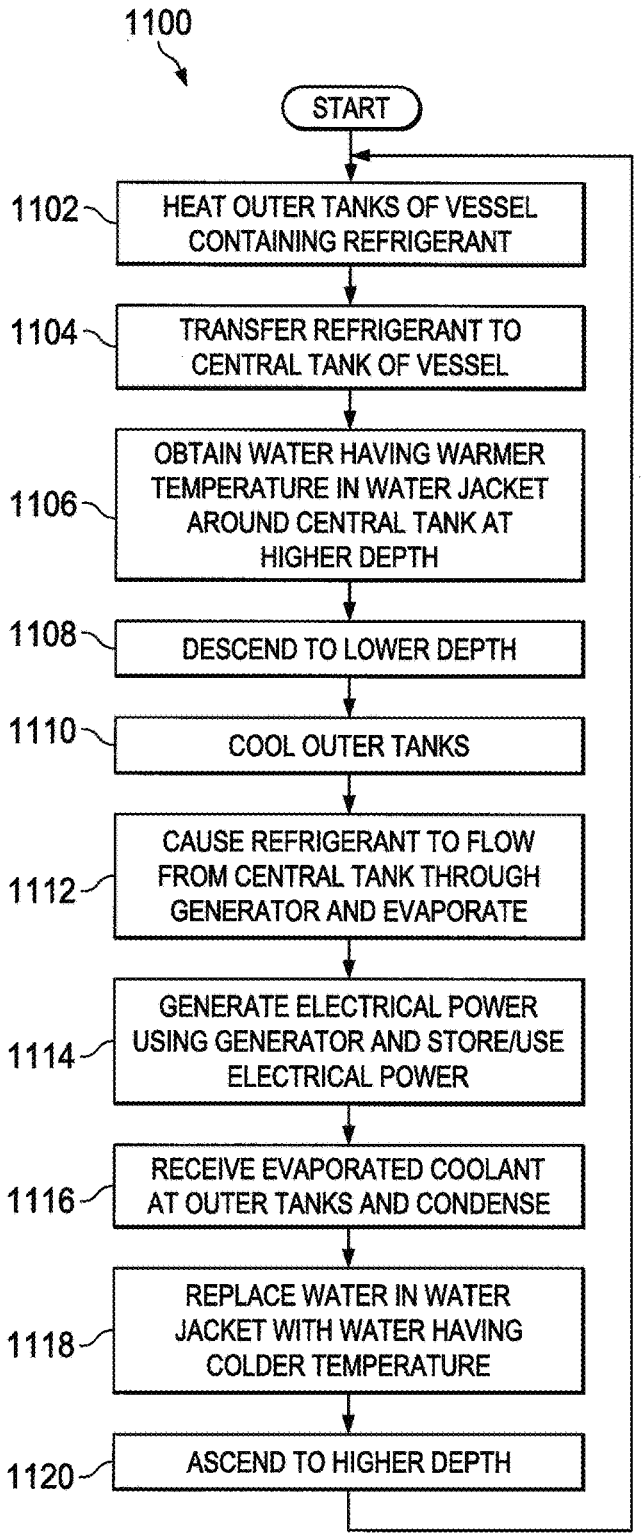
FIG. 11 illustrates a second example method for periodically charging a vessel or other system using thermal energy conversion in accordance with this disclosure.

FIG. 11 illustrates a second example method 1100 for periodically charging a vessel or other system using thermal energy conversion in accordance with this disclosure. For ease of explanation, the method 1100 is described with respect to the system 900 operating in the vessel 300. However, the method 1100 could be used in any other suitable device or system.

As shown in FIG. 11 and referring to components described in FIGS. 9A-10D, one or more outer tanks of a vessel are heated at step 1102. This could include, for example, sunlight or warmer water in an ambient environment heating the tanks 912-914 in the system 900. The one or more tanks contain liquid refrigerant 1010, which is similarly heated. During this time, one or more valves 1008 can be closed to help lower the effective volume and thereby increase the pressure within the tanks 912-914. The refrigerant is transferred to a central tank at step 1104. This could include, for example, the controller 302 of the vessel 300 opening the valves 916-918 to allow the liquid refrigerant 1010 to move from the tanks 912-914 to the tank 908. The tank 908 can be under significantly less pressure here, such as due to all valves 1006 being opened and the insulated water jacket 910 containing colder water.

Water having a warmer temperature is obtained in the water jacket of the vessel when the vessel is at a higher depth at step 1106. This could include, for example, the controller 302 of the vessel 300 opening the valves 920 to obtain warmer water in the insulated water jacket 910. The vessel descends to a lower depth at step 1108. This could include, for example, the controller 302 of the vessel 300 controlling the propulsion components 318 so that the vessel 300 dives to a desired depth. Due to the colder ambient environment, the one or more outer tanks are cooled at step 1110. This could include, for example, the tanks 912-914 cooling to a temperature of about 5° C., which can occur during and after the descent.

The liquid refrigerant flows from the central tank through a generator and evaporates at step 1112. This could include, for example, the controller 302 of the vessel 300 opening the valves 1014 and 1020 to open a fluid passageway between the tank 908 and the generator 1012. The higher pressure in the tank 908 pushes the liquid refrigerant 1010 out of the tank 908 and through the generator 1012, which can include an evaporator and a heat exchanger. During this time, one or more valves 1006 can be closed to help maintain the fill percentage and pressure in the effective volume of the tank 908. Electrical power is generated by the generator and stored or used at step 1114. This could include, for example, the generator 1012 generating DC power based on the refrigerant flow, and the DC power can be provided to the power conditioner 314 and stored in the power storage 316 or used by the vessel 300.

Evaporated refrigerant is received at the one or more outer tanks and condenses at step 1116. The evaporated refrigerant can be pulled into the tanks 912-914 due to the lower temperature and therefore lower pressure in the tanks 912-914. Once the power generation is completed, the valves 1014 and 1020 can be closed, and the water in the water jacket is replaced with colder water at step 1118. This could include, for example, the controller 302 of the vessel 300 opening the valves 920 to obtain colder water in the insulated water jacket 910. At some point (such as after a desired amount of operation), the vessel can ascend at step 1120, and the method 1100 can be repeated.

Although FIG. 11 illustrates a second example of a method 1100 for periodically charging a vessel or other system using thermal energy conversion, various changes may be made to FIG. 11. For example, while shown as a series of steps, various steps in FIG. 11 could overlap, occur in parallel, occur in a different order, or occur any number of times. As a particular example, steps 1112-1116 generally overlap during the production of electrical power.

In some embodiments, various functions described in this patent document are implemented or supported by a computer program that is formed from computer readable program code and that is embodied in a computer readable medium. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

It may be advantageous to set forth definitions of certain words and phrases used throughout this patent document. The terms "application" and "program" refer to one or more computer programs, software components, sets of instructions, procedures, functions, objects, classes, instances, related data, or a portion thereof adapted for implementation in a suitable computer code (including source code, object code, or executable code). The term "communicate," as well as derivatives thereof, encompasses both direct and indirect communication. The terms "include" and "comprise," as well as derivatives thereof, mean inclusion without limitation. The term "or" is inclusive, meaning and/or. The phrase "associated with," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

The description in the present application should not be read as implying that any particular element, step, or function is an essential or critical element that must be included in the claim scope. The scope of patented subject matter is defined only by the allowed claims. Moreover, none of the claims is intended to invoke 35 U.S.C. § 112(f) with respect to any of the appended claims or claim elements unless the exact words "means for" or "step for" are explicitly used in the particular claim, followed by a participle phrase identifying a function. Use of terms such as (but not limited to) "mechanism," "module," "device," "unit," "component," "element," "member," "apparatus," "machine," "system," "processor," or "controller" within a claim is understood and intended to refer to structures known to those skilled in the relevant art, as further modified or enhanced by the features of the claims themselves, and is not intended to invoke 35 U.S.C. § 112(f).

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the scope of this disclosure, as defined by the following claims.

What is claimed is:

1. An apparatus comprising:

multiple tanks each configured to receive and store a liquid refrigerant under pressure;

one or more insulated water jackets each configured to receive and retain water around at least part of an associated one of the tanks;

at least one generator configured to receive a flow of the liquid refrigerant and to generate electrical power based on the flow of the liquid refrigerant;

one or more first valves configured to control the flow of the liquid refrigerant between the tanks and through the at least one generator; and one or more second valves configured to control a flow of the water into and out of the one or more insulated water jackets.

2. The apparatus of claim 1, wherein:

the one or more insulated water jackets comprise a first insulated water jacket and a second insulated water jacket;

the multiple tanks comprise a first tank within the first insulated water jacket and a second tank within the second insulated water jacket; and the at least one generator comprises a first generator and a second generator.

3. The apparatus of claim 2, wherein a controller is configured to control the first and second valves in order to:

cause the first insulated water jacket to receive and retain warmer water;

cause the second insulated water jacket to receive and retain colder water; and cause the liquid refrigerant to move from the first tank through the second generator to the second tank.

4. The apparatus of claim 3, wherein the controller is further configured to control the first and second valves in order to:

cause the second insulated water jacket to receive and retain warmer water;

cause the first insulated water jacket to receive and retain colder water; and cause the liquid refrigerant to move from the second tank through the first generator to the first tank.

5. The apparatus of claim 1, wherein:

a first thermal energy conversion subsystem comprises the tanks, the one or more insulated water jackets, the at least one generator, the one or more first valves, and the one or more second valves;

the apparatus further comprises a second thermal energy conversion subsystem; and the flow of the liquid refrigerant in the first thermal energy conversion subsystem is substantially opposite a flow of liquid refrigerant in the second thermal energy conversion subsystem.

6. The apparatus of claim 1, wherein the at least one generator comprises at least one Pelton turbine.

7. The apparatus of claim 1, wherein:

the multiple tanks comprise a first tank and a second tank; and a controller is configured to control the first and second valves in order to cause the liquid refrigerant to repeatedly flow back and forth between the first and second tanks.

8. The apparatus of claim 1, wherein:

the one or more insulated water jackets comprise a single insulated water jacket; and the multiple tanks comprise a first tank within the insulated water jacket and one or more second tanks.

9. The apparatus of claim 8, wherein a controller is configured to control the first and second valves in order to:

cause the insulated water jacket to receive and retain colder water;

after the one or more second tanks have warmed, cause the liquid refrigerant to move from the one or more second tanks to the first tank;

cause the insulated water jacket to receive and retain warmer water; and after the one or more second tanks have cooled, cause the liquid refrigerant to move from the first tank through the at least one generator, evaporate, move into the one or more second tanks, and condense.

10. The apparatus of claim 9, wherein each tank is segmented and comprises multiple third valves configured to alter an effective volume of the tank.

11. A system comprising:

a vessel comprising a body and fins projecting from the body;

the vessel also comprising a thermal energy conversion system, the thermal energy conversion system comprising:

multiple tanks each configured to receive and store a liquid refrigerant under pressure;

one or more insulated water jackets each configured to receive and retain water around at least part of an associated one of the tanks;

at least one generator configured to receive a flow of the liquid refrigerant and to generate electrical power based on the flow of the liquid refrigerant;

one or more first valves configured to control the flow of the liquid refrigerant between the tanks and through the at least one generator; and one or more second valves configured to control a flow of the water into and out of the one or more insulated water jackets;

the vessel further comprising a controller configured to control the first and second valves.

12. The system of claim 11, wherein:

the one or more insulated water jackets comprise a first insulated water jacket and a second insulated water jacket;

the multiple tanks comprise a first tank within the first insulated water jacket and a second tank within the second insulated water jacket; and the at least one generator comprises a first generator and a second generator.

13. The system of claim 12, wherein the controller is configured to control the first and second valves in order to:

cause the first insulated water jacket to receive and retain warmer water;

cause the second insulated water jacket to receive and retain colder water; and cause the liquid refrigerant to move from the first tank through the second generator to the second tank.

14. The system of claim 13, wherein the controller is further configured to control the first and second valves in order to:

cause the second insulated water jacket to receive and retain warmer water;

cause the first insulated water jacket to receive and retain colder water; and cause the liquid refrigerant to move from the second tank through the first generator to the first tank.

15. The system of claim 11, wherein:

the system further comprises a second thermal energy conversion system; and the flow of the liquid refrigerant in the thermal energy conversion system is substantially opposite a flow of liquid refrigerant in the second thermal energy conversion system.

16. The system of claim 11, wherein:

the one or more insulated water jackets comprise a single insulated water jacket; and the multiple tanks comprise a first tank within the insulated water jacket and one or more second tanks.

17. The system of claim 16, wherein the controller is configured to control the first and second valves in order to:

cause the insulated water jacket to receive and retain colder water;

after the one or more second tanks have warmed, cause the liquid refrigerant to move from the one or more second tanks to the first tank;

cause the insulated water jacket to receive and retain warmer water; and after the one or more second tanks have cooled, cause the liquid refrigerant to move from the first tank through the at least one generator, evaporate, move into the one or more second tanks, and condense.

18. The system of claim 11, wherein:

the body further comprises wings and at least one adjustable ballast, the wings configured to be swept forward or backward depending on whether the vessel is ascending or descending, the at least one adjustable ballast configured to alter a center of gravity of the vessel.

19. A method comprising:

receiving and storing a liquid refrigerant under pressure in at least one of multiple tanks;

receiving and retaining water around at least part of one or more of the tanks using one or more insulated water jackets;

creating a flow of the liquid refrigerant between the tanks, the flow created at least in part based on a pressure differential between the tanks;

generating electrical power based on the flow of the liquid refrigerant using at least one generator;

controlling the flow of the liquid refrigerant between the tanks and through the at least one generator using one or more first valves; and controlling a flow of the water into and out of the one or more insulated water jackets using one or more second valves.

20. The method of claim 19, wherein:

the one or more insulated water jackets comprise a first insulated water jacket and a second insulated water jacket;

the multiple tanks comprise a first tank within the first insulated water jacket and a second tank within the second insulated water jacket;

the at least one generator comprises a first generator and a second generator; and controlling the flow of the liquid refrigerant and controlling the flow of the water comprise:

causing the first insulated water jacket to receive and retain warmer water;

causing the second insulated water jacket to receive and retain colder water;

causing the liquid refrigerant to move from the first tank through the second generator to the second tank;

causing the second insulated water jacket to receive and retain warmer water;

causing the first insulated water jacket to receive and retain colder water; and causing the liquid refrigerant to move from the second tank through the first generator to the first tank.

21. The method of claim 19, wherein:

the one or more insulated water jackets comprise a single insulated water jacket;

the multiple tanks comprise a first tank within the insulated water jacket and one or more second tanks; and controlling the flow of the liquid refrigerant and controlling the flow of the water comprise:

causing the insulated water jacket to receive and retain colder water;

after the one or more second tanks have warmed, causing the liquid refrigerant to move from the one or more second tanks to the first tank;

causing the insulated water jacket to receive and retain warmer water; and after the one or more second tanks have cooled, causing the liquid refrigerant to move from the first tank through the at least one generator, evaporate, move into the one or more second tanks, and condense.

* * * * *